US008232726B2

(12) United States Patent
Seo et al.

(10) Patent No.: US 8,232,726 B2
(45) Date of Patent: Jul. 31, 2012

(54) PLASMA DISPLAY APPARATUS WITH BLACK MATRICES

(75) Inventors: Kyeong Cheol Seo, Gumi-si (KR); Duk Gyu Jang, Gumi-si (KR); Jeong Sik Choi, Gumi-si (KR); Tae Hwa Hwang, Gumi-si (KR)

(73) Assignee: LG Electronics Inc., Seoul (KR)

( * ) Notice: Subject to any disclaimer, the term of this patent is extended or adjusted under 35 U.S.C. 154(b) by 274 days.

(21) Appl. No.: 12/667,962

(22) PCT Filed: Feb. 12, 2009

(86) PCT No.: PCT/KR2009/000683

§ 371 (c)(1),
(2), (4) Date: Jan. 6, 2010

(87) PCT Pub. No.: WO2009/148211

PCT Pub. Date: Dec. 10, 2009

(65) Prior Publication Data

US 2011/0210662 A1 Sep. 1, 2011

(30) Foreign Application Priority Data

Jun. 3, 2008 (KR) ..... 10-2008-0052236
Sep. 17, 2008 (KR) ..... 10-2008-0091235

(51) Int. Cl.
*H01J 17/49* (2012.01)

(52) U.S. Cl. ..... 313/585

(58) Field of Classification Search ..... None
See application file for complete search history.

(56) References Cited

U.S. PATENT DOCUMENTS

| | | | | |
|---|---|---|---|---|
| 2003/0151362 | A1* | 8/2003 | Alberto et al. | 313/586 |
| 2008/0030136 | A1* | 2/2008 | Bae et al. | 313/584 |
| 2008/0100218 | A1* | 5/2008 | Ryu et al. | 313/585 |

FOREIGN PATENT DOCUMENTS

| | | |
|---|---|---|
| JP | 2002-050298 | 2/2002 |
| JP | 2002-304948 | 10/2002 |
| JP | 2005-019405 | 1/2005 |
| JP | 2006-221025 | 8/2006 |

OTHER PUBLICATIONS

PCT International Search Report dated Jun. 1, 2009.

* cited by examiner

*Primary Examiner* — Toan Ton
*Assistant Examiner* — Britt D Hanley
(74) *Attorney, Agent, or Firm* — KED & Associates LLP

(57) ABSTRACT

The present invention relates to a plasma display apparatus. The plasma display apparatus comprises an upper substrate, a first electrode and a second electrode formed on the upper substrate, a lower substrate disposed to face the upper substrate, and a third electrode and a barrier rib formed in the lower substrate. First and second black matrices are formed in the upper substrate and are separated from each other on a same straight line. According to the present invention, while maintaining the function of improving a contrast ratio and reflectance of a black matrix, a short and a spotted pattern that may occur when simultaneous exposure is performed can be reduced, and so the picture quality, the cost of production, and efficiency can be improved.

18 Claims, 22 Drawing Sheets

PLASMA DISPLAY APPARATUS WITH BLACK MATRICES

FIELD OF THE INVENTION

The present invention relates to a plasma display apparatus and, more particularly, to the structure of electrodes and light-shielding units of a panel provided in the plasma display apparatus.

BACKGROUND OF THE INVENTION

In general, in a plasma display panel, a barrier rib formed between an upper substrate and a lower substrate forms one unit cell. Each cell is filled with an inert gas containing a main discharge gas, such as neon (Ne), helium (He), and a mixed gas of Ne+He, and a small amount of xenon (Xe). When the inert gas is discharged by a high frequency voltage, the inert gas generates vacuum ultraviolet rays and irradiates phosphor formed between the barrier ribs, thereby implementing an image. The plasma display panel can be made light and thin and thus has been in the spotlight as next-generation display devices.

In a typical plasma display panel, scan electrodes and sustain electrodes are formed on the upper substrate. The scan electrode and the sustain electrode have a structure in which a transparent electrode and a bus electrode made of expensive indium tin oxide (ITO) in order to secure the aperture ratio of the panel are stacked. In recent years, the main object is to fabricate a plasma display panel which is capable of securing a sufficient driving characteristic and a visual perception characteristic sufficient for a user's viewing, while reducing the manufacturing cost.

DETAILED DESCRIPTION OF THE INVENTION

Problems to be Solved by the Invention

The present invention relates to a plasma display apparatus. The plasma display apparatus can have a structure in which black matrices formed over the barrier ribs of a panel are separated from each other or a structure in which a black matrix formed on the barrier rib of a panel has a groove. In an embodiment, the plasma display apparatus can have a structure in which floating electrodes are separated from each other.

Means for Solving the Problems

According to the plasma display apparatus in accordance with the present invention, the cost of production of a plasma display panel can be reduced because transparent electrodes made of ITO are removed, and the efficiency of a discharge and the brightness of a display image can be improved because protrusion electrodes are used. Further, a failure in the upper substrate of a panel can be reduced and the manufacturing process can be simplified by modifying the structure of black matrices formed over the barrier rib of the panel.

BEST MODE FOR IMPLEMENTING THE INVENTION

Figure 1:
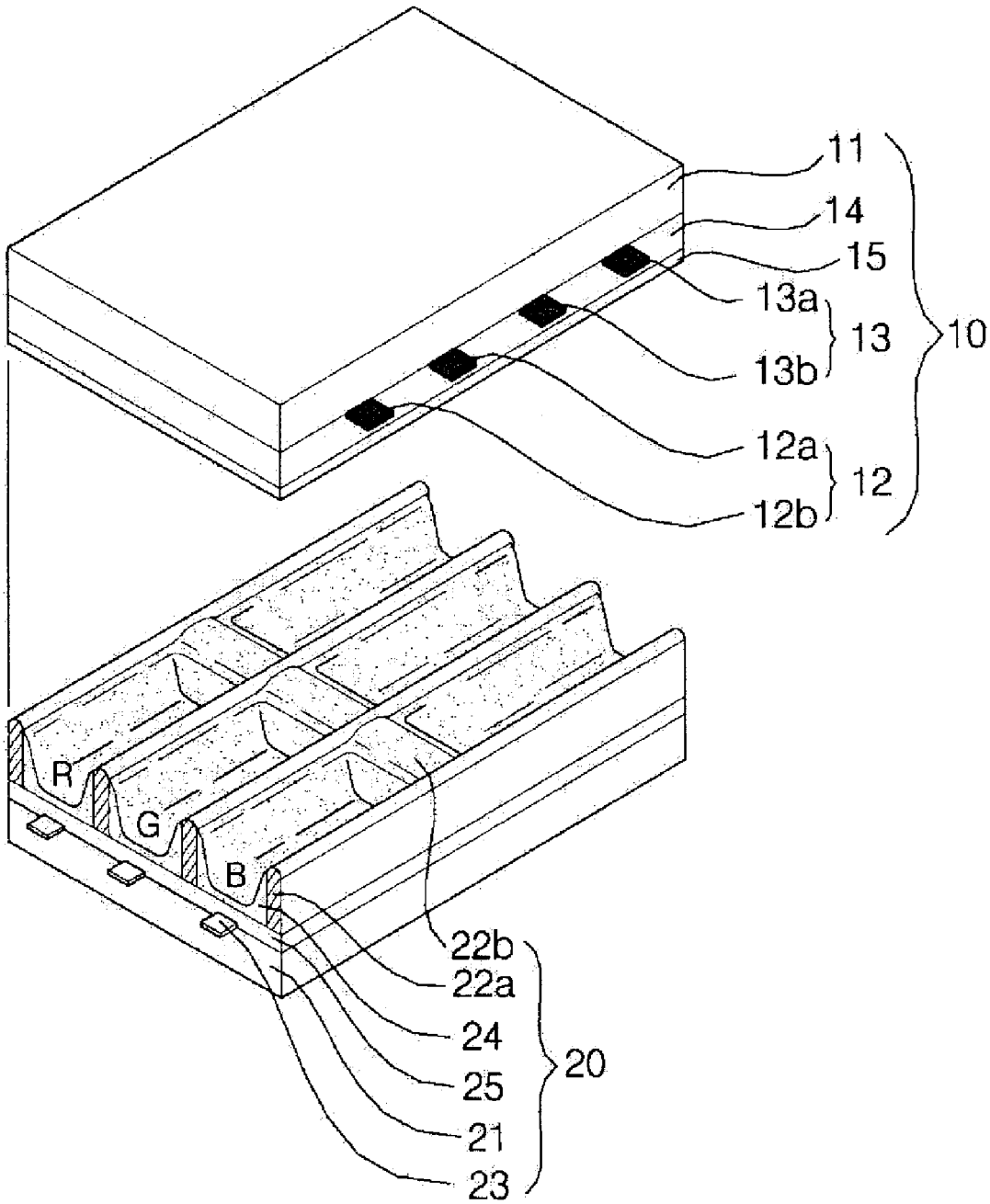
FIG. 1 is a perspective view illustrating an embodiment referring to the structure of a plasma display panel according to the present invention.

Hereinafter, some embodiments of a plasma display apparatus according to the present invention are described in detail with reference to the accompanying drawings. FIG. 1 is a perspective view illustrating an embodiment referring to the structure of a plasma display panel according to the present invention.

Referring to FIG. 1, the plasma display panel includes an upper panel 10 and a lower panel 20 coaleaced with each other with a gap interposed therebetween.

The upper panel 10 includes sustain electrodes 12 and 13 each formed in pairs on an upper substrate 11. The sustain electrodes 12 and 13 are classified into a scan electrode 12 and a sustain electrode 13 according to their functions. The sustain electrode pairs 12 and 13 are covered with an upper dielectric layer 14 for limiting a discharge current and providing insulation between the electrode pairs. A protection layer 15 is formed on a top surface of the upper dielectric layer 14. The protection layer 15 functions to protect the upper dielectric layer 14 from sputtering of charged particles generated when a gas is discharged and to increase the efficiency of emission of secondary electrons.

A discharge gas is injected into discharge spaces partitioned by the upper substrate 11, a lower substrate 21, and barrier ribs 22. The discharge gas preferably includes xenon (Xe) of 10% or more. If the discharge gas includes a mixing ratio of xenon (Xe) of 10% or more as described above, the discharge/emission efficiencies and the brightness of a plasma display panel can be improved.

The lower panel 20 includes a plurality of discharge spaces (i.e., the barrier ribs 22 for partitioning discharge cells) over the lower substrate 21. Address electrode 23 are disposed in a direction to cross the sustain electrode pairs 12 and 13. Phosphor 24 is coated on the surfaces of a lower dielectric layer 25 and the barrier ribs 22 and is configured to emit light by ultraviolet rays generated when the gas is discharged, thus generating a visible ray.

The barrier ribs 22 include longitudinal barrier ribs 22*a* formed in parallel to the address electrodes 23 and traverse barrier ribs 22*b* formed in a direction to cross the address electrodes 23. The barrier ribs 22 function to physically separate the discharge cells from each other and to prevent a visible ray and ultraviolet rays, generated by a discharge, from leaking to neighboring discharge cells.

In the plasma display panel according to the present invention, the sustain electrode pairs 12 and 13 can include only opaque metal electrodes. That is, the sustain electrode pairs 12 and 13 may not be formed of ITO (i.e., the conventional material for transparent electrodes), but may be formed of silver (Ag), copper (Cu), or chrome (Cr) (i.e., the conventional materials for bus electrodes). In other words, each of the dielectric electrode pairs 12 and 13 of the plasma display panel according to the present invention may not include the conventional ITO electrodes, but may include only a single layer of the bus electrodes.

For example, each of the sustain electrode pairs 12 and 13 according to an embodiment of the present invention preferably is formed of silver (Ag), and silver (Ag) preferably has a photosensitive property. Each of the sustain electrode pairs 12 and 13 according to an embodiment of the present invention can have a darker color and a lower transmittance of light than the upper dielectric layer 14, formed on the upper substrate 11, or the lower dielectric layer 24.

R(red), G(green), and B(blue) phosphor layers 24 (i.e., the discharge cells) can have a symmetrical structure having the same width or an asymmetric structure having different widths. In the case of discharge cells having the asymmetric structure, the size can be the width of the R cell<the width of the G cell<the width of the B cell.

As shown in FIG. 1, each of the sustain electrodes 12 and 13 can have a plurality of electrode lines within a single discharge cell. In more detail, the first sustain electrode 12 can be formed of two electrode lines 12*a* and 12*b*. The second sustain electrode 13 can be arranged symmetrically with the first sustain electrode 12 on the basis of a discharge cell and can be formed of two electrode lines 13*a* and 13*b*.

The first and second sustain electrodes 12 and 13 preferably are respectively a scan electrode and a sustain electrode. Consideration is taken with the aperture ratio and the efficiency of discharge diffusion according to use of the opaque sustain electrode pairs 12 and 13. In other words, an electrode line of a narrow width is used with consideration taken of the aperture ratio, and a plurality of electrode lines is used with consideration taken of the efficiency of discharge diffusion. The number of electrode lines can be determined by taking both the aperture ratio and the efficiency of discharge diffusion into consideration.

It is to be noted that the structure shown in FIG. 1 is only an embodiment referring to the structure of the plasma display panel according to the present invention, and the present invention is not limited to the structure of the plasma display panel shown in FIG. 1. For example, a black matrix (BM) having a light-shielding function of reducing reflection by absorbing external light and a function of improving the purity and contrast of the upper substrate 11 can be formed on the upper substrate 11. The black matrix can have a separation-type or integration-type BM structure.

Although a close-type structure in which the discharge cells are closed by the longitudinal barrier ribs 22*a* and the traverse barrier ribs 22*b* is illustrated in FIG. 1, the barrier rib structure of the panel shown in FIG. 1 may have a stripe-type structure including only the longitudinal barrier ribs or a fish bone structure in which protruding portions are formed on the longitudinal barrier ribs with a gap interposed therebetween.

Figure 2:
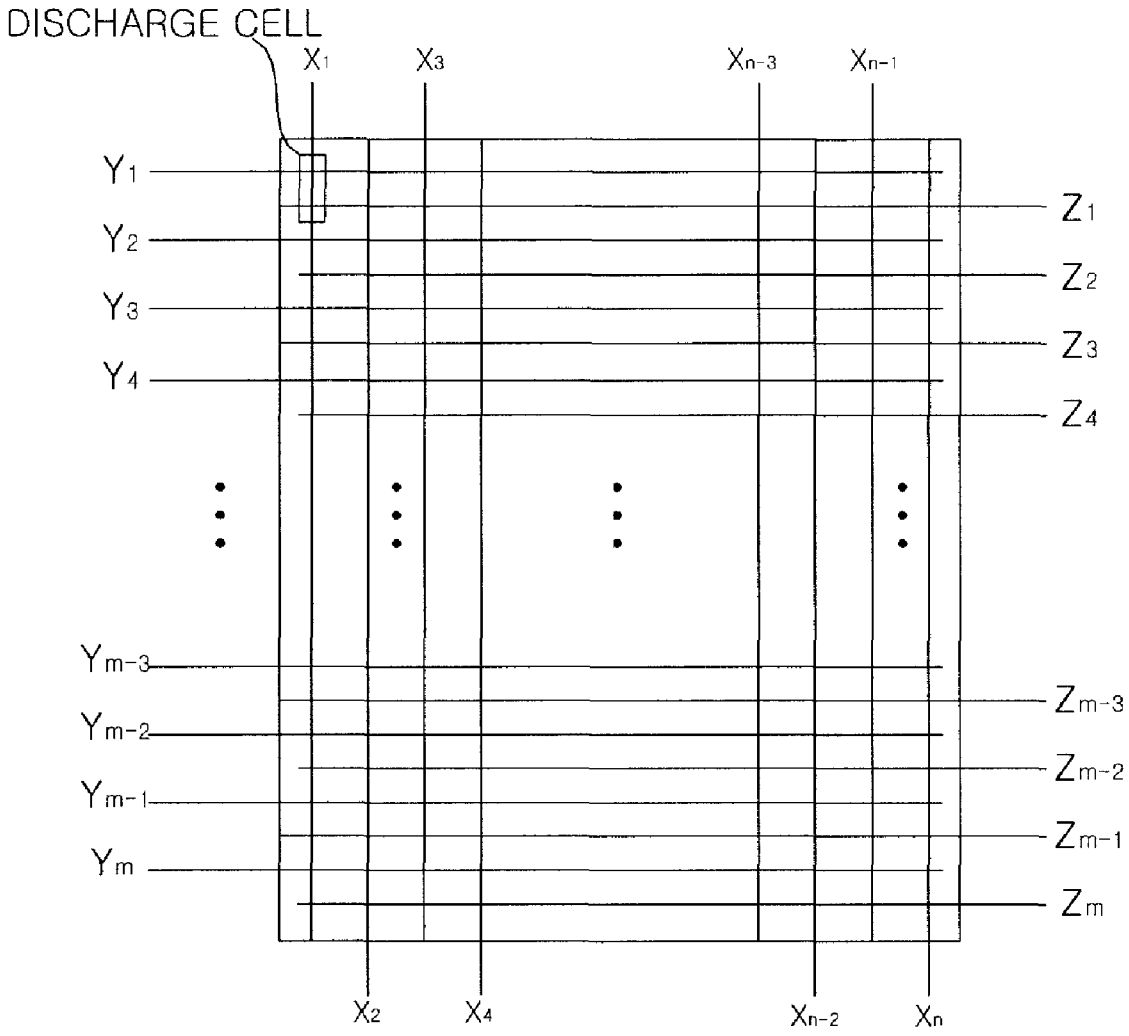
FIG. 2 is a diagram illustrating an embodiment referring to the arrangement of electrodes of the plasma display panel.

FIG. 2 is a diagram illustrating an embodiment referring to the arrangement of electrodes of the plasma display panel. A plurality of the discharge cells constituting the plasma display panel, as shown in FIG. 2, preferably are arranged in a matrix form. Each of the plurality of discharge cells is provided at the intersection of each of scan electrode lines Y1 to Ym, each of sustain electrode lines Z1 to Zm, and each of address electrode lines X1 to Xn. The scan electrode lines Y1 to Ym can be driven sequentially or at the same time, and the sustain electrode lines Z1 to Zm can be driven at the same time. The address electrode lines X1 to Xn can be driven with them divided into odd-numbered lines and even-numbered lines or can be sequentially driven.

It is to be noted that the arrangement of the electrodes shown in FIG. 2 is only an embodiment referring to the arrangement of the electrodes of the plasma display panel according to the present invention, and the present invention is not limited to the arrangement of the electrodes and the method of driving the electrodes shown in FIG. 2. For example, the present invention can be applied to a dual scan method of driving two of the scan electrode lines Y1 to Ym at the same time. In an alternative embodiment, the address electrode lines X1 to Xn can be driven with them divided into upper and lower parts or left and right parts about the central portion of the plasma display panel.

Figure 3:
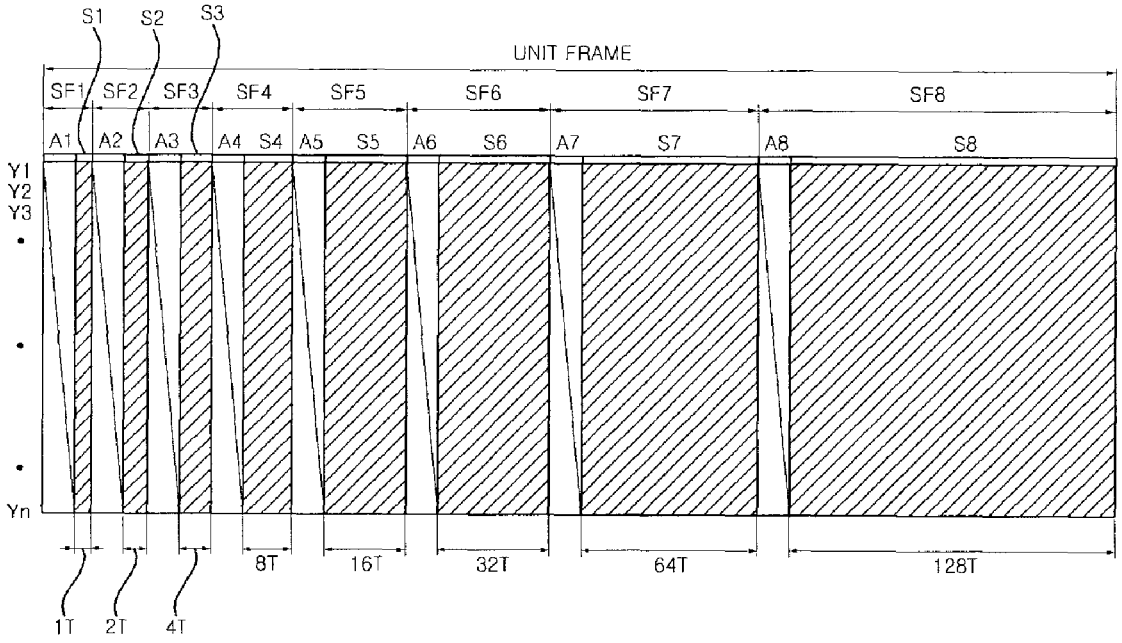
FIG. 3 is a timing diagram illustrating an embodiment referring to a method of classifying one frame into a plurality of subfields and driving the plasma display panel in a time-division manner.

FIG. 3 is a timing diagram illustrating an embodiment referring to a method of classifying one frame into a plurality of subfields and driving the plasma display panel in a time-division manner. A unit frame can be classified into a predetermined number (for example, eight) of subfields SF1, . . . , SF8 in order to achieve the display of a time-division gray level. Each of the subfields SF1, . . . , SF8 is classified into a reset period (not shown), address periods A1, . . . , A8, and sustain periods S1, . . . , S8.

According to an embodiment of the present invention, the reset period can be omitted in at least one of the plurality of subfields. For example, the reset period may exist only in the first subfield or may exist only in a subfield approximately between the first subfield and the remaining subfields.

In each of the address periods A1, . . . , A8, a display data signal is applied to the address electrodes X, and scan signals corresponding to the respective scan electrodes Y are sequentially applied to the address electrodes X.

In each of the sustain periods S1, . . . , S8, a sustain pulse is alternately applied to the scan electrodes Y and the sustain electrodes Z. Accordingly, a sustain discharge is generated in discharge cells on which wall charges are formed in the address periods A1, . . . , A8.

The brightness of a plasma display panel is proportional to the number of sustain discharge pulses within the sustain periods S1, . . . , S8 which are occupied in the unit frame. In the case where one frame to form 1 image is represented by eight subfields and 256 gray levels, a different number of sustain pulses can be sequentially assigned to each of the subfields at a ratio of 1, 2, 4, 8, 16, 32, 64, and 128. For example, to obtain the brightness of 133 gray levels, a sustain discharge has only to be generated by addressing the cells during the subfield1 period, the subfield3 period, and the subfield8 period.

The number of sustain discharges assigned to each subfield can be varied depending on the weight of a subfield according to an automatic power control (APC) step. In other words, although an example in which one frame is classified into the 8 subfields has been described with reference to FIG. 3, the present invention is not limited to the above example, but the number of subfields to form one frame can be changed in various ways according to the design specifications. For example, a plasma display panel can be driven with one frame classified into 8 or more subfields, such as 12 or 16 subfields.

Further, the number of sustain discharges assigned to each subfield can be changed in various ways by taking the gamma characteristic or the panel characteristic into consideration. For example, the degree of gray level assigned to the subfield4 can be lowered from 8 to 6, and the degree of gray level assigned to the subfield6 can be raised from 32 to 34.

Figure 4:
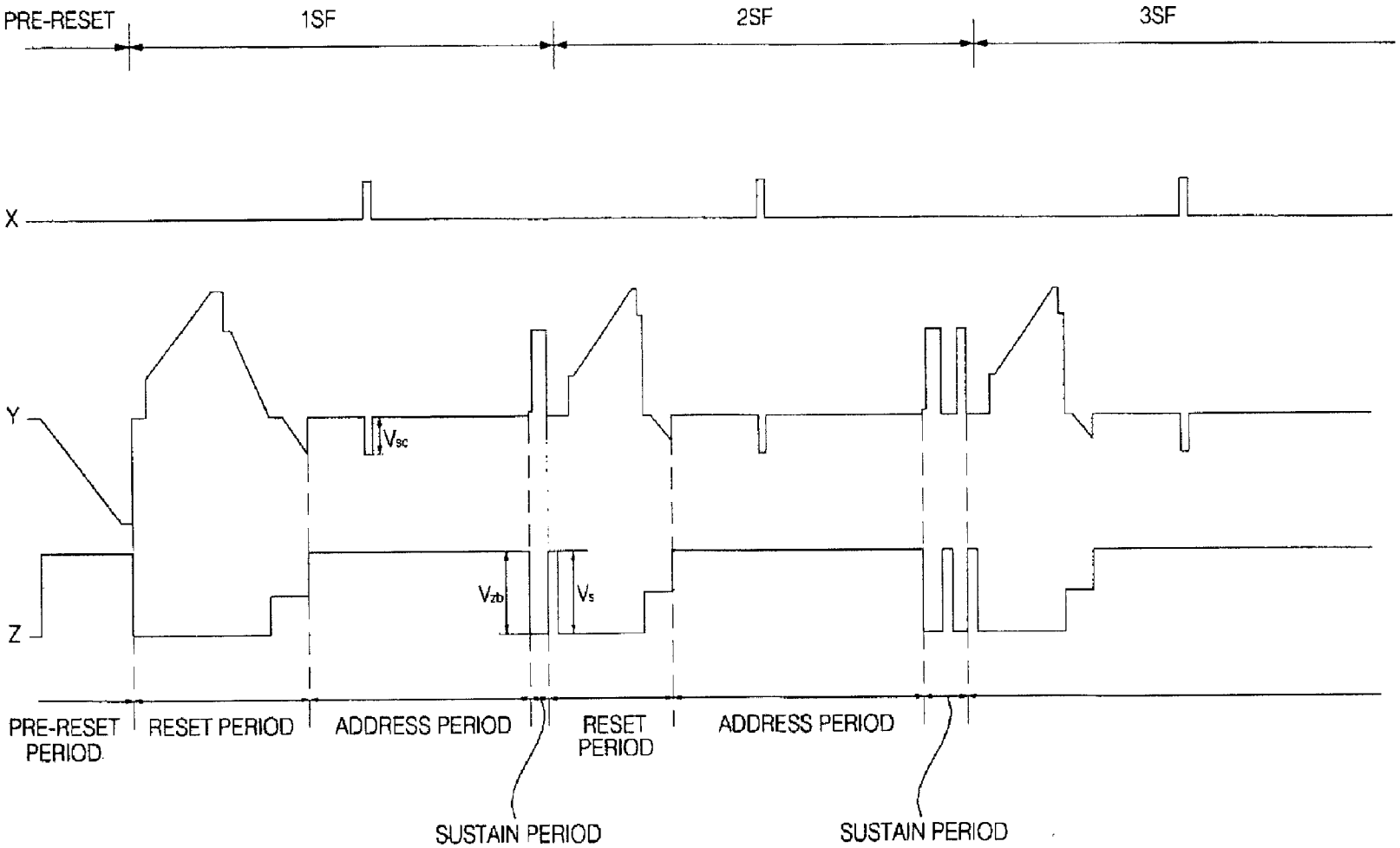
FIG. 4 is a timing diagram illustrating an embodiment referring to the waveforms of driving signals for driving the plasma display panel.

FIG. 4 is a timing diagram illustrating an embodiment referring to the waveforms of driving signals for driving the plasma display panel.

The subfield can include a pre-reset period in which wall charges of the positive polarity are formed in the scan electrodes Y and wall charges of the negative polarity are formed in the sustain electrodes Z, a reset period in which discharge cells of the entire screen are reset using a wall charge distribution formed in the pre-reset period, an address period in which the discharge cells are selected, and a sustain period in which a discharge of the selected discharge cells is sustained.

The reset period is composed of a set-up period and a set-down period. In the set-up period, a ramp-up waveform is applied to all the scan electrodes at the same time, and so a minute discharge is generated in all the discharge cells, thereby forming wall charges. In the set-down period, a ramp-down waveform, falling from a voltage of the positive polarity lower than a peak voltage of the ramp-up waveform, is applied to all the scan electrodes Y at the same time, and so an erase discharge is generated in all the discharge cells. Accordingly, unnecessary charges are erased from spatial charges and the wall charges generated by the set-up discharge.

In the address period, scan signals each having a scan voltage Vsc of the negative polarity are sequentially applied to the scan electrodes Y and, at the same time, a data signal of the positive polarity is applied to the address electrodes X. An address discharge is generated due to a difference in the voltage between the scan signal and the data signal and a wall voltage generated during the reset period, and so the cells are selected.

Meanwhile, to improve the efficiency of the address discharge, a sustain bias voltage Vzb is applied to the sustain electrodes during the address period.

During the address period, the plurality of scan electrodes Y can be classified into two groups or more, and the scan signals can be sequentially supplied to the scan electrodes Y on a group basis. Each of the groups can be classified into two subgroups or more, and the scan signals can be sequentially supplied to the groups on a subgroup basis. For example, the plurality of scan electrodes Y can be classified into a first group and a second group. For example, the scan signals can be sequentially applied to the scan electrodes belonging to the first group and then sequentially applied to the scan electrodes belonging to the second group.

In an embodiment of the present invention, the plurality of scan electrodes Y can be classified into a first group, including the scan electrodes Y located at even-numbered positions, and a second group, including the scan electrodes Y located at odd-numbered positions, according to the positions where the scan electrodes Y are formed on the panel. In an embodiment, the plurality of scan electrodes Y can be classified into a first group, including the scan electrodes Y disposed on the upper side, and a second group, including the scan electrodes Y disposed on the lower side, about the center of the panel.

The scan electrodes Y, belonging to the first group classified using the above method, can be classified into a first subgroup, including the scan electrodes Y located at even-numbered positions and a second subgroup, including the scan electrodes Y located at odd-numbered positions, or can be classified into a first subgroup, including the scan electrodes Y disposed on the upper side, and a second subgroup, including the scan electrodes Y disposed on the lower side, about the center of the first group.

In the sustain period, a sustain pulse having a sustain voltage Vs is alternately applied to the scan electrodes and the sustain electrodes, and so a sustain discharge is generated between the scan electrodes and the sustain electrodes in the form of a surface discharge.

The width of a first sustain signal or a last sustain signal, of a plurality of the sustain signals alternately applied to the scan electrodes and the sustain electrodes in the sustain period, can be greater than that of each of the remaining sustain pulses.

After the sustain discharge is generated, an erase period in which wall charges remaining in the scan electrodes or the sustain electrodes of an on-cell selected in the address period are erased by generating a weak discharge can be further included.

The erase period can be included in each of all the subfields or some of the subfields. In this erase period, an erase signal for generating the weak discharge preferably can be applied to electrodes to which the last sustain pulse has not been applied during the sustain period.

A ramp-type signal gradually rising, a low-voltage wide pulse, a high-voltage narrow pulse, an exponential signal, a half-sinusoidal pulse or the like can be used as the erase signal.

In addition, to generate the weak discharge, a plurality of pulses can be sequentially applied to the scan electrodes or the sustain electrodes.

It is to be noted that the driving waveforms shown in FIG. 4 are only embodiments referring to signals for driving the plasma display panel according to the present invention, and the present invention is not limited to the waveforms shown in FIG. 4. For example, the pre-reset period can be omitted, the polarities and voltage levels of the driving signals shown in FIG. 4 can be changed, if appropriate, and an erase signal for erasing wall charges can be applied to the sustain electrodes after the sustain discharge is completed. Alternatively, a single sustain driving method of generating a sustain discharge by applying the sustain signal to either the scan electrodes Y or the sustain electrodes Z is also possible.

FIGS. 5 to 12 are cross-sectional views illustrating embodiments referring to the structure of electrodes formed on the upper substrate of the plasma display panel according to an embodiment of the present invention. Only the structure of the sustain electrode pair 12 and 13 formed in one of the discharge cells of the plasma display panel shown in FIG. 1 is simply shown in FIGS. 5 and 12.

Figure 5:
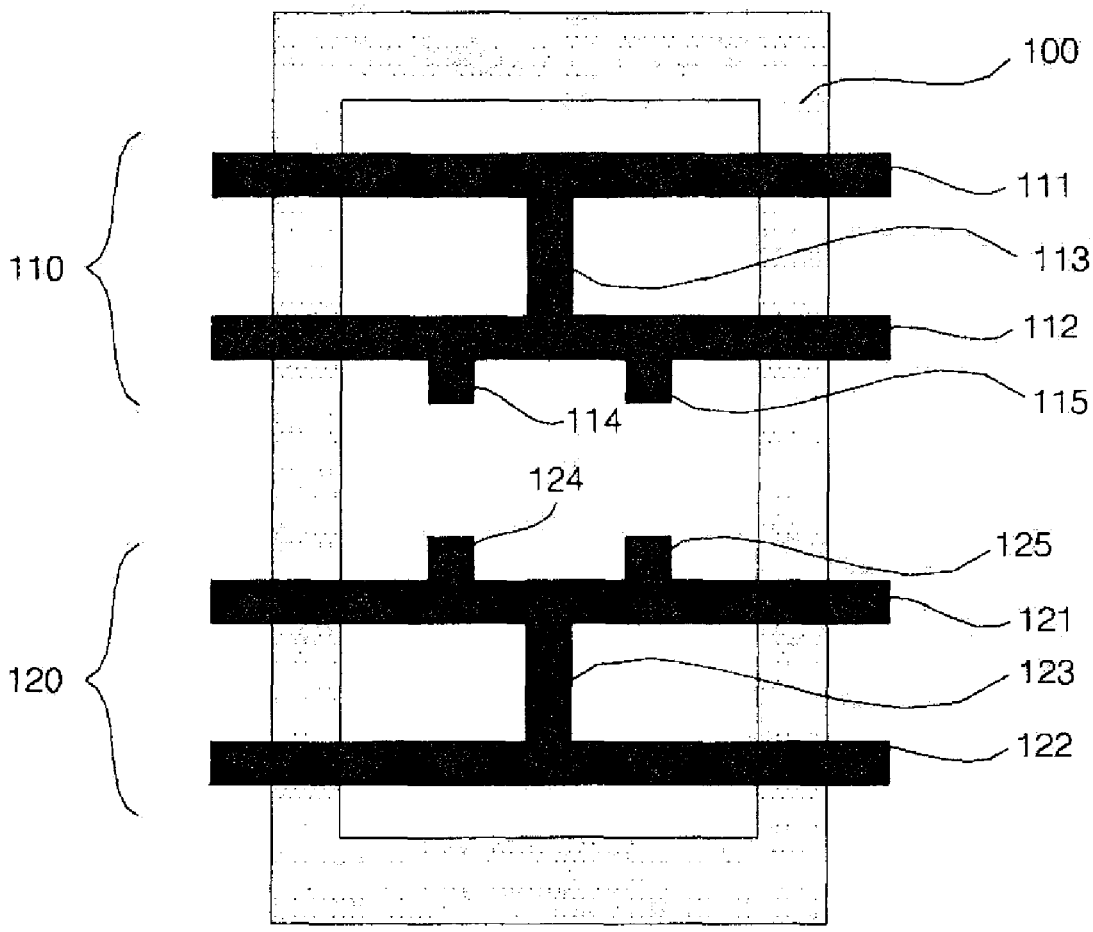
FIGS. 5 to 12 are cross-sectional views illustrating embodiments referring to the structure of electrodes formed on the upper substrate of the plasma display panel according to an embodiment of the present invention.

Referring to FIG. 5, sustain electrodes 110 and 120 according to the embodiment of the present invention are symmetrical to each other about the discharge cell and are formed in pairs over the substrate. The sustain electrode 110 can include at least two electrode lines 111 and 112 and two protrusion electrodes 114 and 115. The sustain electrode 120 can include at least two electrode lines 121 and 122 and two protrusion electrodes 124 and 125. The electrode lines 111, 112, 121, and 122 are disposed to cross the discharge cell. The two protrusion electrodes 114 and 115 are connected to the electrode line 112 which is the closest to the center of the discharge cell, and the two protrusion electrodes 124 and 125 are connected to the electrode line 121 which is the closest to the center of the discharge cell.

The sustain electrodes 110 and 120 can further include connection electrodes 113 and 123, respectively, connecting the two electrode lines 111, 112 and 121, 122, respectively.

The electrode lines 111, 112, 121, and 122 are disposed to cross the discharge cell and are extended in one direction of the plasma display panel. To improve the aperture ratio, the electrode line according to an embodiment of the present invention has a narrow width. Further, in order to improve the efficiency of discharge diffusion, the plurality of electrode lines 111, 112, 121, and 122 is used, but the number of electrode lines preferably can be determined by taking the aperture ratio into consideration.

When the plasma display panel is driven, the protrusion electrodes 114, 115, 124, and 125 function to lower a discharge firing voltage. Accordingly, the discharge firing voltage of a plasma display panel can be lowered because a discharge is generated by a low discharge firing voltage between the neighboring protrusion electrodes 114, 115 and 124 125. Here, the discharge firing voltage can refer to a voltage level at which the discharge starts when a pulse is supplied to any one of the sustain electrode pair 110 and 120.

The connection electrodes 113 and 123 help the discharge, started between the protrusion electrodes 114, 115 and 124, 125, to easily diffuse from the center of the discharge cell to the electrode lines 111 and 122 that are placed in the distance.

As described above, the discharge firing voltage can be lowered by the protrusion electrodes 114, 115 and 124, 125, and the efficiency of discharge diffusion can be improved by the connection electrodes 113 and 123 and the plurality of electrode lines 111, 112, 121, and 122. Accordingly, the total efficiency of emission of a plasma display panel can be improved. This enables the existing ITO transparent electrodes to be removed even without reducing the brightness of a plasma display panel.

Figure 6:
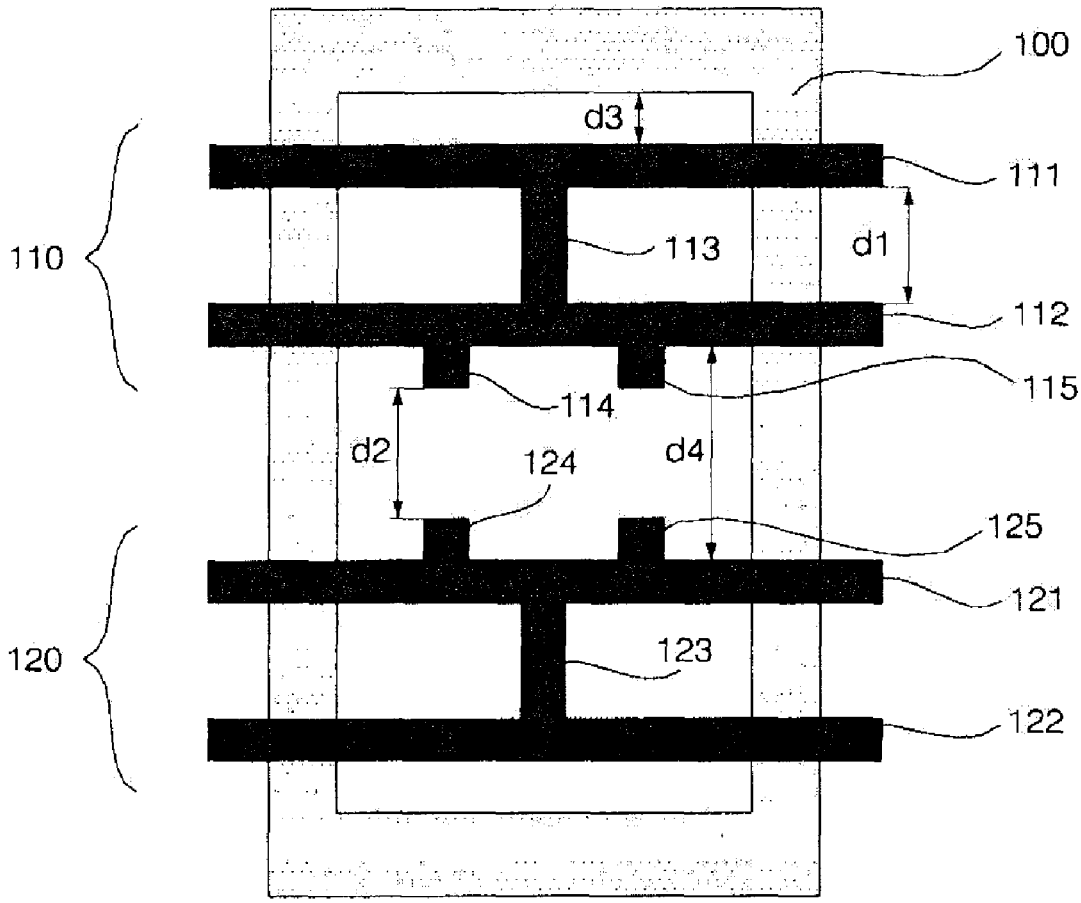

Referring to FIG. 6, with an increase in the interval 'd1' between two neighboring electrode lines 111 and 112, the aperture ratio of the panel can be increased, but the efficiency of discharge diffusion of the panel can be decreased. If an interval 'd2' between two protrusion electrodes 114 and 124 which generate a discharge is increased, a discharge firing voltage can be increased.

The following table 1 shows the results of measuring discharge firing voltages according to a change in the interval 'd1' between the two neighboring electrode lines 111 and 112 and the interval 'd2' between the protrusion electrodes 114 and 124. Since the size of a discharge cell is limited, the interval 'd2' between the protrusion electrodes 114 and 124 can be decreased with an increase in the interval 'd1' between the two neighboring electrode lines 111 and 112.

TABLE 1

| d1 | d2 | DISCHARGE FIRING VOLTAGE |
|---|---|---|
| 250 | 30 | 192 V |
| 240 | 40 | 188 V |
| 230 | 50 | 180 V |
| 220 | 60 | 179 V |
| 210 | 70 | 179 V |
| 200 | 80 | 181 V |
| 190 | 90 | 180 V |
| 180 | 100 | 179 V |
| 175 | 105 | 187 V |
| 170 | 110 | 188 V |
| 165 | 115 | 190 V |
| 160 | 120 | 191 V |

Figure 27:
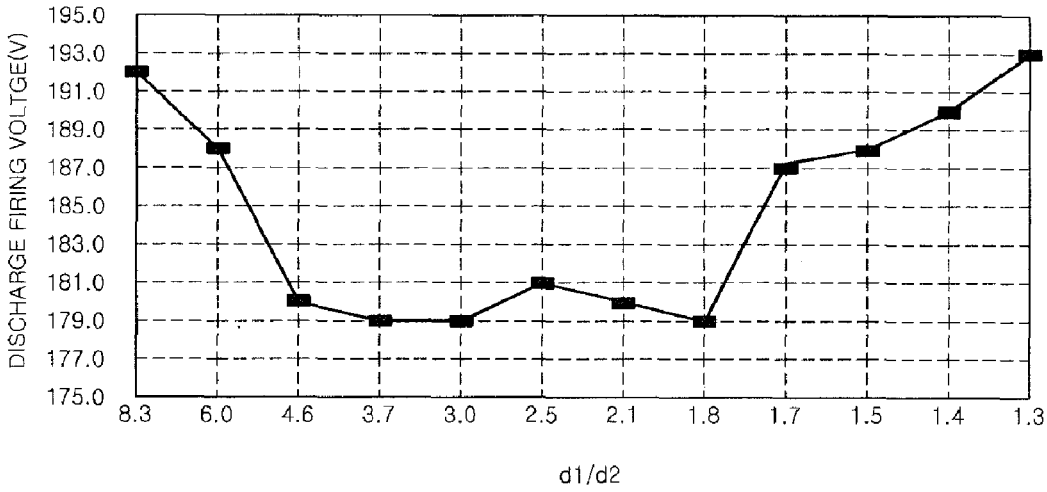
FIG. 27 is a graph showing the results of measuring discharge firing voltages of the plasma display panel according to the present invention.

FIG. 27 is a graph showing the relationship between the ratios d1/d2 and the discharge firing voltages according to the measurement results of Table 1.

Referring to Table 1 and FIG. 27, with a decrease in the ratio d1/d2, the interval 'd1' between the two neighboring electrode lines 111 and 112 is decreased, and so the efficiency of discharge diffusion is improved. Accordingly, if the interval 'd1' is 4.6 times greater than the interval 'd2', the discharge firing voltage is reduced to 180V or less.

However, if the ratio d1/d2 exceeds 1.8 times, the discharge firing voltage is abruptly increased to 187V or more with an increase in the interval 'd2' between the protrusion electrodes 114 and 124.

Accordingly, when the interval 'd1' between the two neighboring electrode lines 111 and 112 is 1.8 to 4.6 times greater than the interval 'd2' between the protrusion electrodes 114 and 124, the discharge firing voltage can be stably reduced to a low voltage of about 180V.

Further, to prevent a reduction in the brightness of a display image by securing the aperture ratio of the panel and also uniformly generate a discharge in the entire region of a discharge cell, the interval 'd1' between the two neighboring electrode lines 111 and 112 can be 2.1 to 2.8 times greater than the interval 'd2' between the protrusion electrodes 114 and 124.

Assuming that the length of the protrusion electrodes 114 and 124 is 50 μm to 100 μm, when the interval 'd1' between the two neighboring electrode lines 111 and 112 is 0.6 to 1.5 times greater than the interval 'd4' between the electrode lines 112 and 121 according to the measurement results of Table 1, the discharge firing voltage can be stably reduced to a low voltage of about 180V.

Assuming that the interval 'd2' between the protrusion electrodes 114 and 124 is constant, the interval 'd1' between the two neighboring electrode lines 111 and 112 and the interval 'd3' between the electrode line 111 and a barrier rib 100 can be inversely proportional to each other.

As described above, when the interval 'd1' between the two neighboring electrode lines 111 and 112 is increased, an area in which the discharge of a discharge cell is generated is widened, but the efficiency of discharge diffusion of the panel can be decreased.

In the case where a discharge is generated only in some region of a discharge cell, deterioration of the picture quality, such as a spotted pattern, can be generated in a display image.

Accordingly, when the interval 'd1' between the two neighboring electrode lines 111 and 112 is 1 to 1.7 times greater than the interval 'd3' between the electrode line 111 and the harrier rib 100, a discharge can be uniformly generated in the entire region of a discharge cell, thereby being capable of reducing deterioration of the picture quality occurring in a display image.

Figure 7:
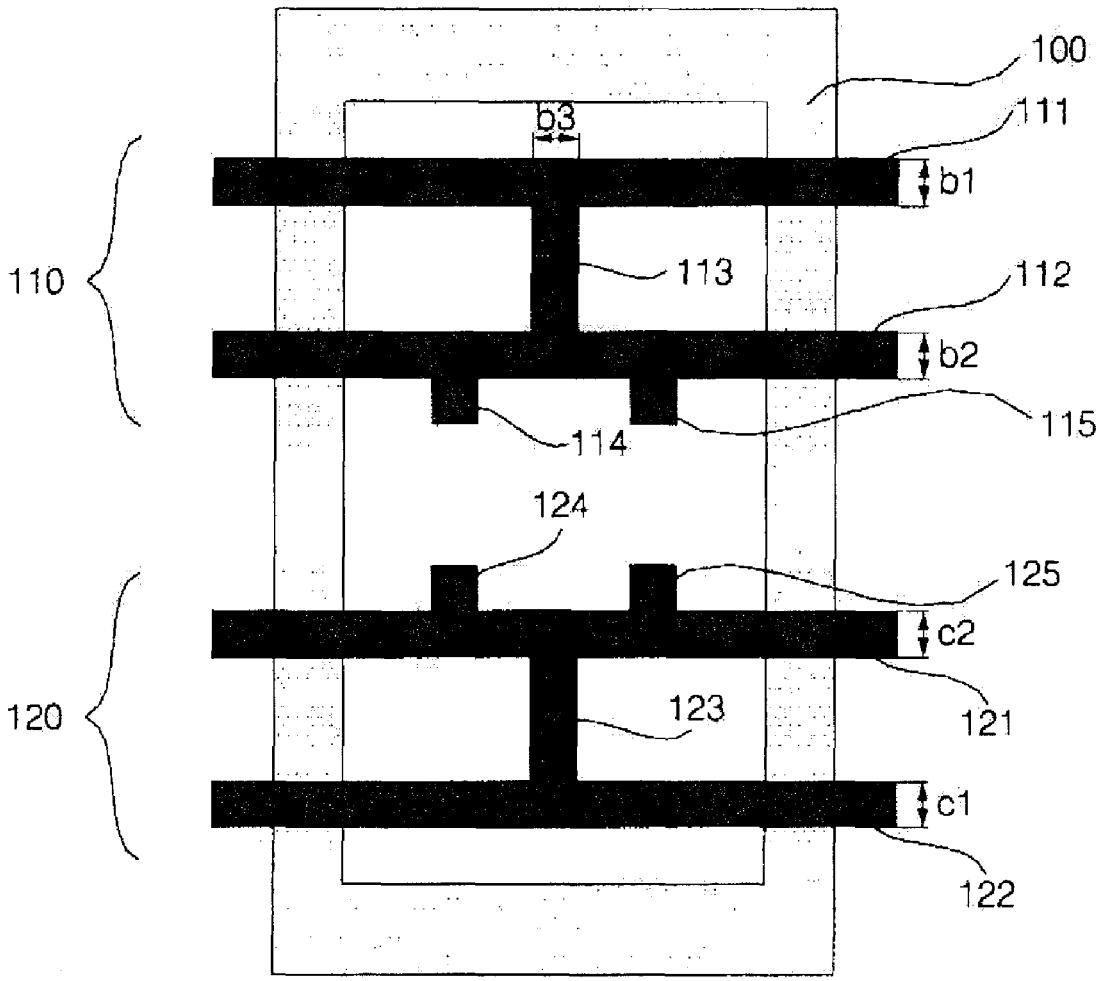

Referring to FIG. 7, the two neighboring electrode lines 111 and 112 can have different widths 'b1' and 'b2'.

In the case where the amounts of wall charges respectively formed in the two electrode lines 111 and 112 by an address discharge differ, the amount of light generated when a sustain discharge is generated can be different according to the positions of the two electrode lines 111 and 112. Accordingly, deterioration of the picture quality, such as a spotted pattern, can occur in a display image.

For example, in the case of the electrode line 111 located in the outskirts of a discharge cell, from among the two electrode lines 111 and 112, wall charges are formed by a diffused discharge. Accordingly, the amount of wall charges formed in the electrode line 111 by an address discharge can be smaller than that of wall charges formed in the electrode line 112, located close to the center of the discharge cell, by the address discharge. Thus, if the width 'b1' of the electrode line 111 located in the outskirts of the discharge cell is made larger than the width 'b2' of the electrode line 112 located close to the center of the discharge cell, the amounts of wall charges formed in the two electrode lines 111 and 112 can become uniform.

When the amounts of wall charges formed in the two electrode lines 111 and 112 are made uniform as described above, a discharge can be uniformly generated in the entire region of the discharge cell, and so deterioration of the picture quality occurring in a display image can be reduced.

The following table 2 shows the results of measuring the brightness and whether a spotted pattern occurred in a display image according to a change in the widths b1 and b2 of the two neighboring electrode lines 111 and 112.

TABLE 2

| b1(μm) | b2(μm) | Whether spotted pattern occurred? | Brightness (cd/m$^2$) |
|---|---|---|---|
| 28 | 40 | X | 485 |
| 32 | 40 | X | 485 |
| 36 | 40 | X | 484 |
| 40 | 40 | X | 480 |
| 44 | 40 | ○ | 479 |
| 48 | 40 | ○ | 479 |
| 52 | 40 | ○ | 475 |
| 56 | 40 | ○ | 474 |
| 60 | 40 | ○ | 471 |
| 64 | 40 | ○ | 468 |
| 68 | 40 | ○ | 467 |
| 72 | 40 | ○ | 465 |
| 76 | 40 | ○ | 461 |
| 80 | 40 | ○ | 459 |
| 84 | 40 | ○ | 431 |
| 88 | 40 | ○ | 410 |
| 92 | 40 | ○ | 390 |
| 96 | 40 | ○ | 375 |

Referring to Table 2, when the width 'b1' of an electrode line 111 located in the outskirts of a discharge cell is 44 μm or more, deterioration of the picture quality, such as a spotted pattern, is not generated in a display image.

However, when the width 'b1' of the electrode line 111 located in the outskirts of the discharge cell is more than 80 μm, the brightness of a display image is abruptly reduced to less than 460 cd/m'.

Accordingly, when the width 'b1' of the electrode line 111 located in the outskirts of the discharge cell is 1.1 to 2 times greater than the width 'b2' of an electrode line 112 located close to the center of the discharge cell, deterioration of the picture quality of a display image can be prevented and the brightness of the display image can also be improved.

To make uniform the amounts of wall charges formed in the two electrode lines 111 and 112 by increasing the amount of wall charges formed in the electrode line 111 located in the outskirts of the discharge cell without greatly reducing the efficiency of discharge diffusion, the width 'b1' of the electrode line 111 located in the outskirts of the discharge cell can be 1.15 to 1.5 times greater than the width 'b2' of the electrode line 112 located close to the center of the discharge cell.

The gap between the two neighboring electrode lines 111 and 112 can be 180 μm to 230 μm as described above with reference to Table 1, and the width 'b1' of the electrode line 111 located in the outskirts of the discharge cell can be 44 μm to 80 μm as described above with reference to Table 2. Thus, the interval 'd1' between the two neighboring electrode lines 111 and 112 can be 2.25 to 5.2 times greater than the width 'b1' of the electrode line 111 located in the outskirts of the discharge cell.

For the above reason, the widths c1 and c2 of the two neighboring electrode lines 122 and 121 located on the lower side of the discharge cell can have different values within the above range.

Figure 8:
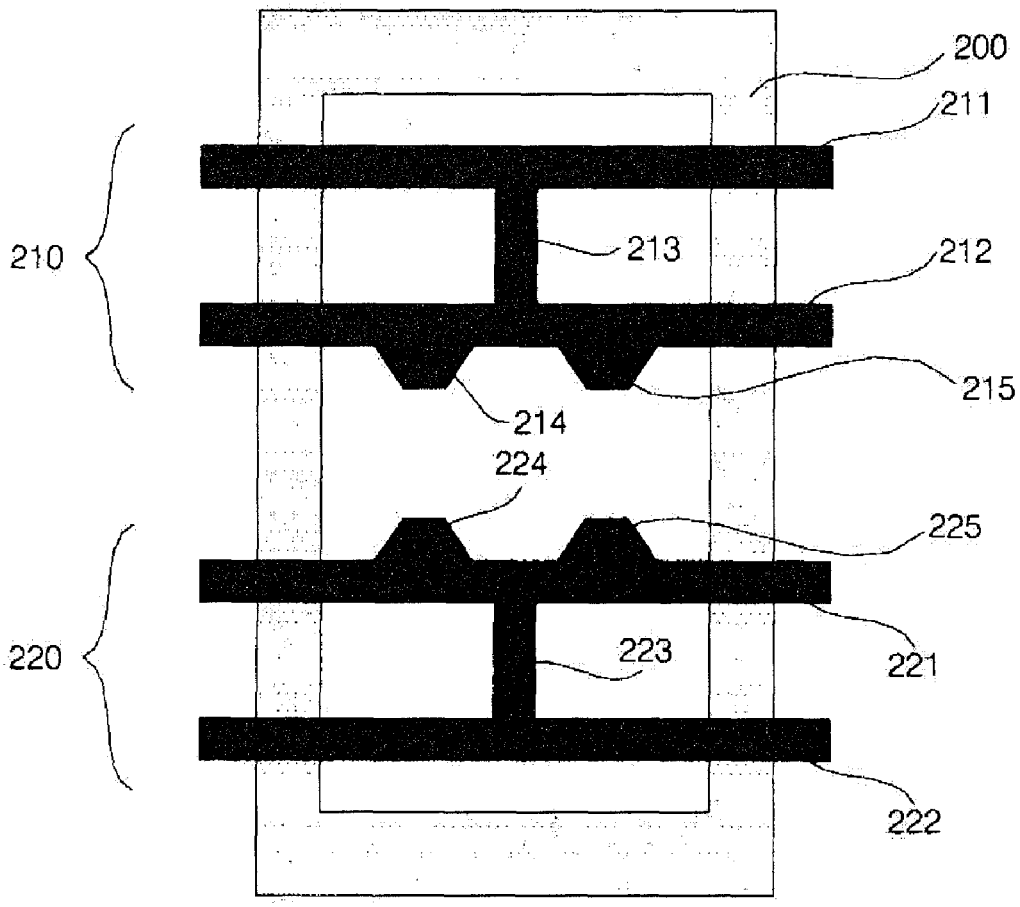
Figure 9:
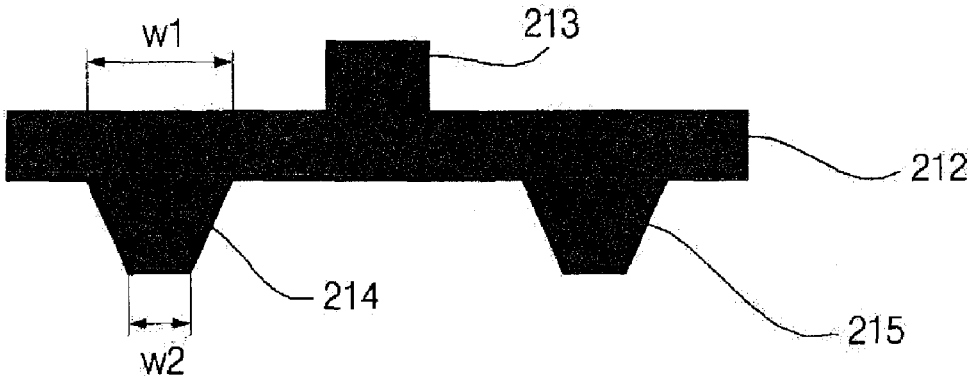

Referring to FIG. 8, protrusion electrodes 214, 215 and 224, 225 protruding from respective electrode lines 212 and 221 have the bottoms connected to the respective electrode lines 212 and 221. Here, the widths of the bottoms of the protrusion electrodes 214, 215 and 224, 225 can be different from the widths of the tops of the protrusion electrodes 214, 215 and 224, 225. Accordingly, a plasma display panel can be prevented from being damaged because the protrusion electrodes 214, 215 and 224, 225 are separated from the electrode lines 212 and 221 when external impact occurs.

The protrusion electrodes 214, 215 and 224, 225 constructed as above can improve the efficiency of a discharge because the surface area in which a discharge can be generated between the protrusion electrodes 214, 215 and 224, 225 is increased.

The following table 3 shows whether electrodes were damaged and whether a spotted pattern was generated in a display image according to a change in the bottom width 'w1' of the protrusion electrode 214.

TABLE 3

| w1(μm) | w2(μm) | Whether electrodes were damaged | Whether spotted pattern occurred? |
|---|---|---|---|
| 10 | 30 | ○ | X |
| 15 | 30 | ○ | X |
| 20 | 30 | ○ | X |
| 25 | 30 | X | X |
| 30 | 30 | X | X |
| 35 | 30 | X | X |
| 40 | 30 | X | X |
| 45 | 30 | X | X |
| 50 | 30 | X | X |
| 55 | 30 | X | X |
| 60 | 30 | X | X |
| 65 | 30 | X | X |
| 70 | 30 | X | X |
| 75 | 30 | X | X |
| 80 | 30 | X | X |
| 85 | 30 | X | X |
| 90 | 30 | X | X |
| 95 | 30 | X | X |
| 100 | 30 | X | X |
| 105 | 30 | X | X |
| 110 | 30 | X | X |
| 115 | 30 | X | X |
| 120 | 30 | X | X |
| 125 | 30 | X | X |
| 130 | 30 | X | X |
| 135 | 30 | X | ○ |
| 140 | 30 | X | ○ |
| 145 | 30 | X | ○ |
| 150 | 30 | X | ○ |

Referring to Table 3, when the bottom width 'w1' of the protrusion electrode 214 is 20 μm or less, damage to the protrusion electrode resulting from external pressure, etc. is not generated. However, when the bottom width 'w1' of the protrusion electrode 214 is 135 μm or more, a spotted pattern in the longitudinal direction is generated in a display image because an interval between the two neighboring protrusion electrodes 214 and 224 is irregular.

Accordingly, when the bottom width 'w1' of the protrusion electrode 214 is 0.7 to 4.5 times greater than the top width 'w2' thereof, damage to the protrusion electrode can be prevented and deterioration of the picture quality in the display image can be reduced.

To reduce a discharge firing voltage and improve the efficiency of discharge diffusion, the bottom width 'w1' of the protrusion electrode 214 can be twice or more the top width 'w2' thereof.

Furthermore, when the distance between the bottoms of the two neighboring protrusion electrodes 214 and 215 is 0.9 to 2 times greater than the bottom width 'w1' of the protrusion electrode 214, the aperture ratio of the panel can be secured and a discharge can also be uniformly generated in the entire region of the discharge cell.

Figure 10:
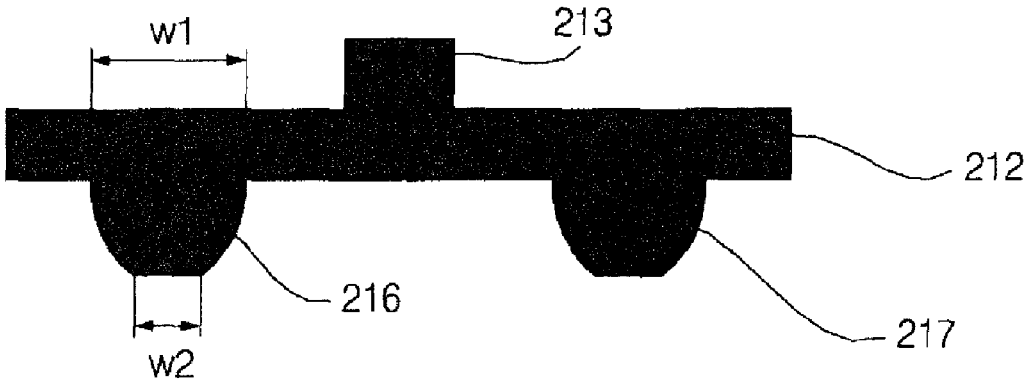
Figure 11:
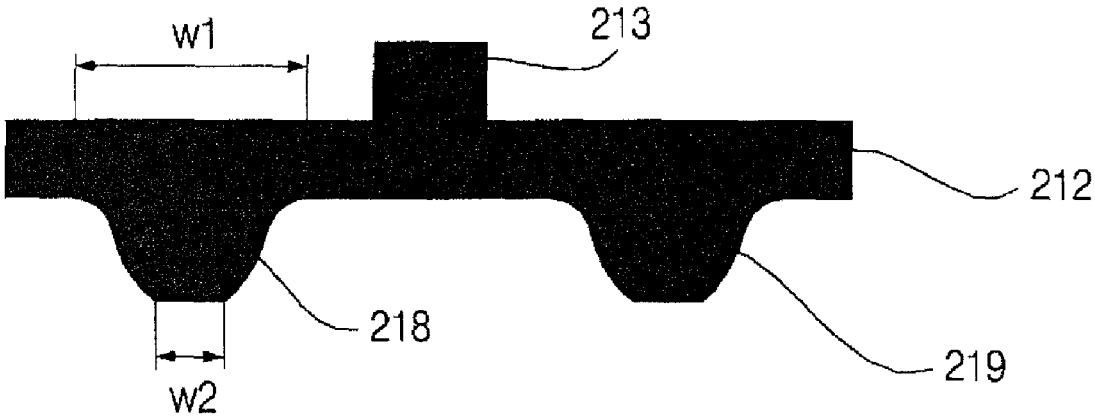

As shown in FIGS. 10 and 11, if each of the inclined planes of protrusion electrodes 216, 217, 218, and 219 has a curved section, the surface area of each of the protrusion electrodes 216, 217, 218, and 219 for a discharge can be increased, and so the efficiency of a discharge can be improved.

Figure 12:
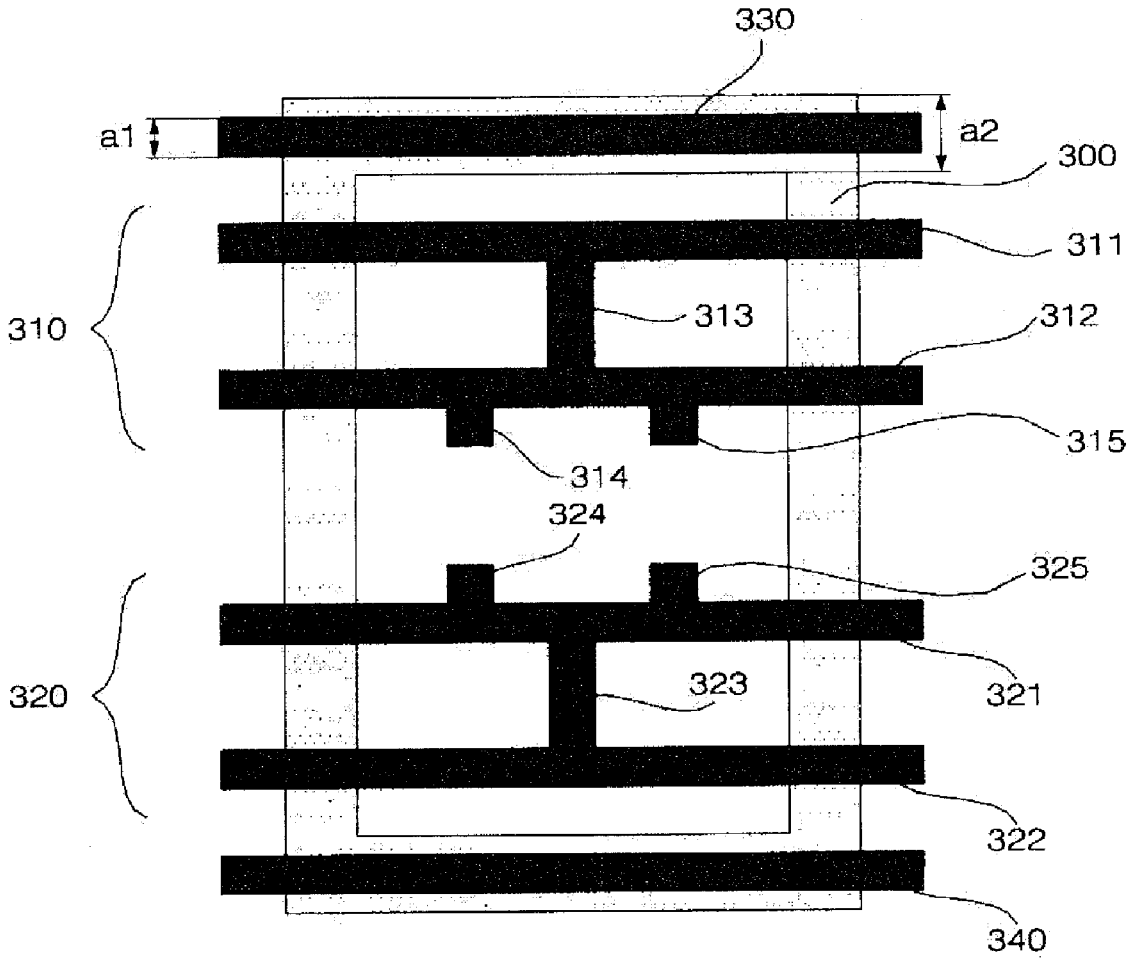

Referring to FIG. 12, to improve the aperture ratio of the panel, black matrices 330 and 340 can be formed on a barrier rib 300, and a width 'a1' of each of the black matrices 330 and 340 can be smaller than a width 'a2' of the barrier rib 300.

Further, to improve the aperture ratio of the panel and the dark room contrast of a display image, the width 'a1' of each of the black matrices 330 and 340 can be 0.5 times greater than the width 'a2' of the barrier rib 300.

Meanwhile, the black matrices 330 and 340 formed on the barrier rib and the electrodes 310 and 320 formed on the upper substrate of the panel can be exposed to light or sintered at the same time. Accordingly, the panel manufacturing process can be simplified, and the time that it takes to perform the process can be reduced.

However, in the case where the electrodes 310 and 320 and the black matrices 330 and 340 having a structure, such as that shown in FIG. 12, are exposed to light at the same time, there may be a difficulty in forming the electrode panel because of a short between the electrode line 311 and the black matrix 330 and between the electrode line 322 and the black matrix 340.

The plasma display apparatus according to an embodiment of the present invention may include an upper substrate, a first electrode and a second electrode formed on the upper substrate, a lower substrate disposed to face the upper substrate, and a third electrode and a barrier rib formed in the lower substrate. Here, first and second black matrices are formed in the upper substrate and are separated from each other on the same straight line.

FIGS. 13 to 17 are cross-sectional views illustrating embodiments referring to the structure of electrodes formed on the upper substrate of the plasma display panel according to an embodiment of the present invention.

Figure 13:
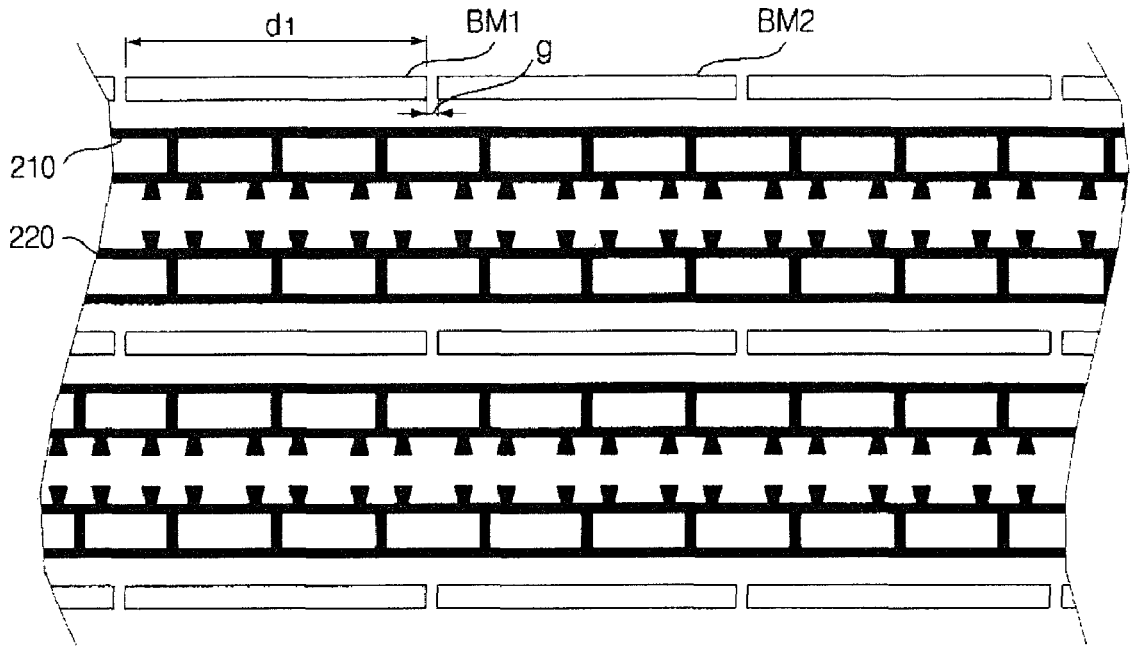
FIGS. 13 to 17 are cross-sectional views illustrating embodiments referring to the structure of electrodes formed on the upper substrate of the plasma display panel according to an embodiment of the present invention.

Referring to FIG. 13, a plurality of black matrices, including a first black matrix and a second black matrix, are configured to form a line pattern on the same straight line and are separated from each other. Even though the black matrix becomes electrically conductive because of an alien substance, etc., it does not have an influence on other black matrices. The shape in which the black matrices are arranged with them separated from each other is similar to a shape in which symbols '-' used in a sentence are consecutively arranged. Accordingly, such as structure including the plurality of black matrices according to the present invention is called a dash-type black matrix (BM).

First electrodes 210, second electrodes 220, and the line patterns can be formed in parallel. That is, the first and second black matrices can be formed in parallel to the first electrodes and the second electrodes.

The black matrix functions to enhance a contrast by optically shielding unnecessary discharge regions. Since the black matrix must have a low transmittance and a low reflectance, it can be made of material in which black oxide is mixed with glass of a low melting point or material including at least one of cobalt (Co) series oxide, chrome (Cr) series oxide, manganese (Mn) series oxide, copper (Cu) series oxide, iron (Fe) series oxide, and carbon (C) series oxide. The black matrix is formed using a screen printing method or a photosensitive paste method.

The black matrix is first formed through processes, such as printing and exposure, and the electrodes are formed through separate processes. To reduce the time taken for the panel manufacturing process and more facilitate the manufacturing process, the exposure processes can be integrated, and the bus electrodes and the black matrices can be exposed and sintered over the upper substrate of the panel at the same time.

If, as described above, the electrodes and the black matrices are exposed and sintered at the same time, there may be a problem in that the electrodes and the black matrices are short-circuited. When the electrodes and the black matrices are short-circuited, a streak of a bright belt corresponding to the traverse length of the entire active region is visible to the naked eye because the black matrices are interconnected. It has a bad influence on the picture quality.

Further, if the structure of the bus electrodes is reduced in order to prevent a short between the electrodes and the black matrices when exposure is performed, there is a problem in that the efficiency of emission is reduced. If the width of the black matrix is reduced, there is a problem in that a contrast ratio and a reflectance characteristic are deteriorated.

In accordance with the present invention, although a short occurs in one of the first and second black matrices, only the corresponding black matrix is influenced and the remaining black matrices are not influenced because the first and second black matrices are separated from each other. Accordingly, a bright stripe belt does not occur. Further, since the width of the bus electrode and the black matrix needs not to be changed, there is an advantage in that the panel manufacturing process and the cost of production can be reduced through the integrated exposure process. Moreover, reflectance, a contrast ratio, and efficiency can be maintained to a high level of quality.

The following table 4 shows the results of comparing the reflectance of a typical black matrix having a connection structure and the reflectance of the dash-type black matrices having 1, 5, and 10 pixel units. Here, a symbol 'SCI' indicates a direct reflectance, and a symbol 'SCE' indicates an indirect reflectance. This experiment was performed in an ITO-less model without ITO electrodes, and the ITO-less model is managed with the indirect reflectance SCE of 20 or less.

TABLE 4

| Reflectance | Typical mass-production | dash 1 pixel | dash 5 pixel | dash 10 pixel |
|---|---|---|---|---|
| SCI | 23.9 | 24.48 | 23.17 | 24.09 |
| SCE | 17.46 | 18.20 | 16.68 | 17.58 |

Referring to Table 4, the quality condition for the indirect reflectance SCE of 20 or less regarding reflectance measurement conditions was satisfied, and there was no significant difference in the reflectance between the typical black matrix and the dash-type black matrices. Differences in the detailed numerical value resulted from a panel uniformity rather than differences in the dash-type black matrices.

Further, the plurality of black matrices according to the present invention can be configured in the dash form in a unit of 1 cell or a unit of 1 to several pixels. Since color and light is generated or represented in the cell or pixel unit, the black matrices can be configured based on the above unit such that the unit of light generated and the leakage of light to neighboring cells or pixels can be managed at the same time.

The first and second electrodes may be bus electrodes. In other words, ITO electrodes can be removed.

The length of the first black matrix or the second black matrix can be an integer times the traverse length of one cell. The size of a cell can be changed according to conditions, such as the resolution of a plasma display panel. 1 pixel is chiefly formed of three cells, but the number of cells can be changed. A plurality of the black matrices can be configured in the dash form having a size corresponding to the 1 cell unit or the unit of 1 to several pixels. In the present invention, the length of the black matrix indicates a long-axis length, and the width of the black matrix indicates a short-axis length shorter than the long-axis length. The traverse length of a cell can be defined as a length, including a traverse barrier rib or the traverse length of a discharge space.

Figure 14:
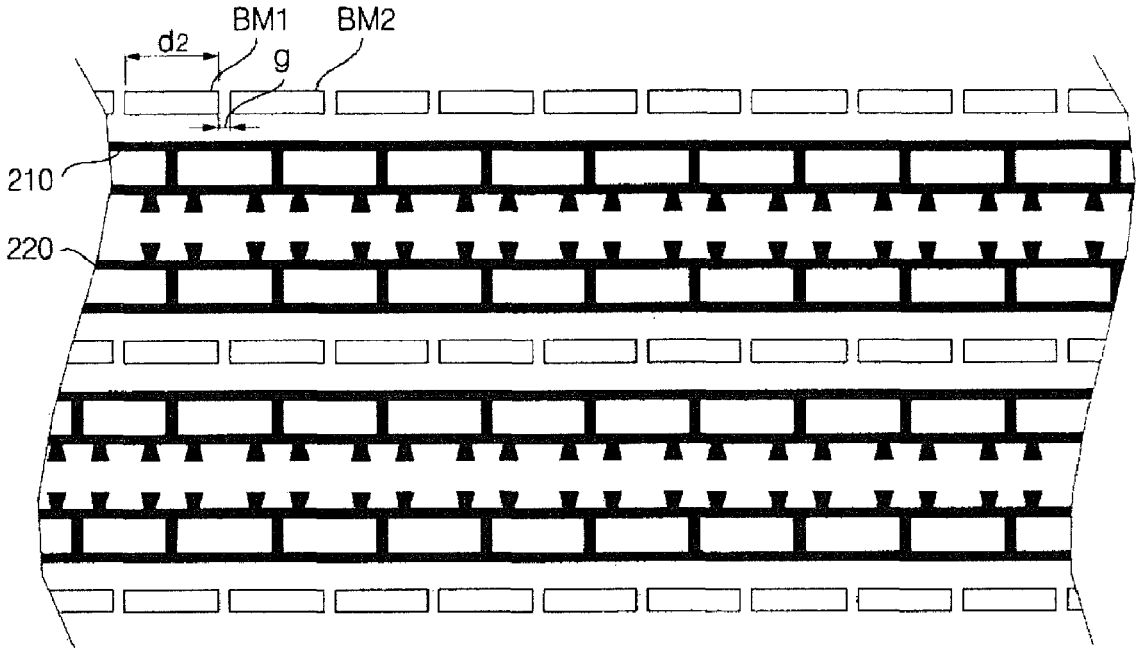

FIG. 13 shows the dash-type BM structure including black matrices each having a length 'd1' corresponding to 1 pixel, and FIG. 14 shows a dash-type BM structure including black matrices each having a length 'd2' corresponding to 1 cell unit.

The first and second black matrices of the present invention can have different lengths. Although FIGS. 13 and 14 illustrate the line patterns of the black matrices each having a constant length, each line pattern can have the plurality of black matrices with different lengths. For example, a black matrix located on the left or right side of the panel can have the length 'd2', and a black matrix located at the center of the panel can have the length 'd1' according to the danger of a possible short.

In the plasma display apparatus according to the present invention, an interval 'g' between the first and second black matrices preferably ranges from 30 μm to 50 μm. If the interval 'g' between the first and second black matrices is less than 30 μm, there is a possibility that the first and second black matrices may be electrically interconnected because of a variation in the process. If the interval 'g' between the first and second black matrices is more than 50 μm, light can be leaked, and so a contrast ratio can be reduced.

In the case where the black matrices are separated from each other on the basis of a pixel, spots results from a short can be reduced to 1/1920 to 1/850 of conventional spots, although there may be a change depending on the resolution of a screen, the number of traverse pixels, the unit of separation in which black matrices forming a dash type are separated from each other, and so on. With an increase in the resolution, the number of pixels is increased and the decrement in spots is gradually increased. Accordingly, the picture quality of the panel can be improved up to a level which is almost invisible to the naked eye.

The first black matrices BM1 or the second black matrices BM2 can be formed in the lower substrate in such a way as to overlap with the traverse barrier rib formed in a direction to cross the third electrode. The black matrices function to optically shield unnecessary discharge regions and enhance a contrast ratio. The traverse barrier rib functions to prevent a visible ray and ultraviolet rays, generated by a discharge, from leaking to neighboring discharge cells. Accordingly, if the black matrices are configured to overlap with the traverse barrier rib, the leakage of light to neighboring discharge cells can be more effectively prevented.

In addition, to improve the aperture ratio of the panel, the width of each black matrix can be smaller than the width of the barrier rib.

Figure 15:
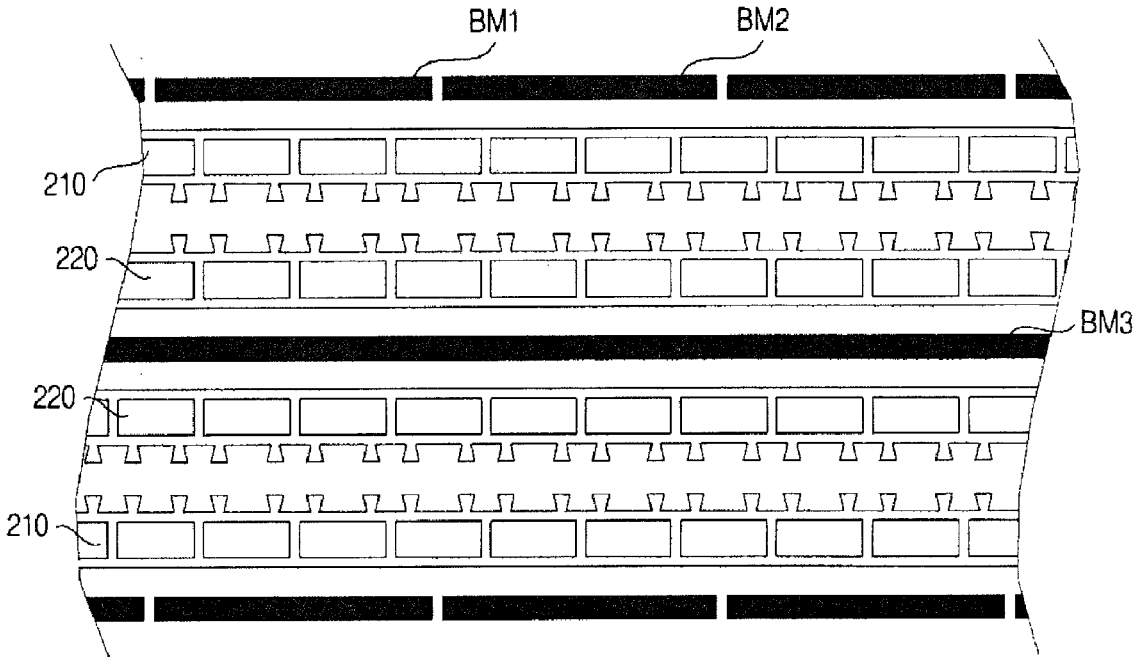

FIG. 15 is a diagram showing an embodiment referring to the structure of electrodes and black matrices formed over the upper substrate of the plasma display panel according to the present invention.

A third black matrix BM3 can be formed on the upper substrate in such a way as to overlap with a traverse barrier rib configured to cross the third electrodes formed in the lower substrate.

Here, the first and second electrodes can be arranged in two discharge cells neighboring the traverse barrier rib such that they are symmetrical to each other about the traverse barrier rib, as shown in FIG. 15. In the case of the discharge cells neighboring up and down about the traverse barrier rib, when viewed from the upper side, first electrodes 210, second electrodes 220, second electrodes 220, and first electrodes 210 in this order can be arranged.

The second electrodes 220 neighboring the traverse barrier rib can be sustain electrodes. The sustain electrodes are chiefly constituted with common electrodes, and the danger of a possible short between the sustain electrodes differs from the danger of a possible short between the scan electrodes and the danger of a possible short between the scan electrodes and the sustain electrodes. Accordingly, the first black matrices BM1 and the second black matrices BM2 neighboring the scan electrodes are formed on the same line with them separated from each other. However, the third black matrix BM3 between the sustain electrodes are formed in a straight line such that a greater spacer can be shielded and a contrast can be improved.

Figure 16:
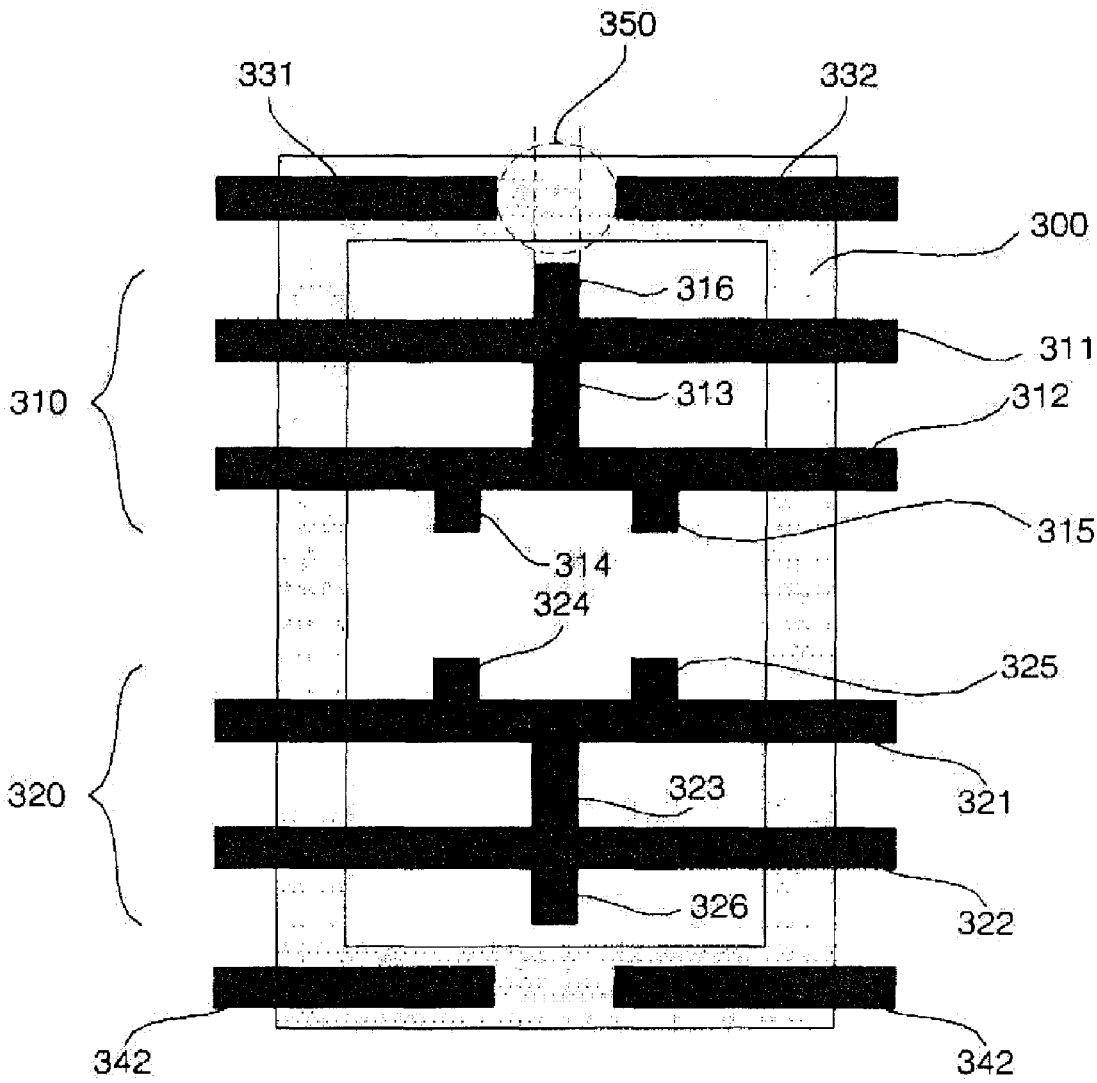

In the case where, in the structure shown in FIG. 12, electrodes 310 and 320 of the upper substrate respectively include second protrusion electrodes 316 and 326 protruding from respective electrode lines 311 and 322 toward the traverse barrier ribs as shown in FIG. 16, if simultaneous exposure for the electrodes and the black matrices is performed as described above, a failure may happen due to a short between the second protrusion electrodes 316 and 326 and respective black matrices 330 and 340 when driving the panel.

In the plasma display apparatus according to the present invention, black matrices 331 and 332 formed over the traverse barrier rib can be separated from each other at the central portion of the traverse barrier rib. Accordingly, the pattern of the electrodes 310 and 320 formed on the upper substrate can be easily formed, and a short between the electrodes 310 and 320 and the black matrices 330 and 340 formed on the upper substrate can be prevented.

FIG. 16 is a cross-sectional view showing an embodiment referring to the structure of the black matrices formed over the upper substrate of the plasma display panel according to the present invention.

Referring to FIG. 16, the second protrusion electrodes 316 and 326 function to diffuse a discharge, generated between first protrusion electrode 314, 315 and 324, 325, up to the outskirts of the discharge cell on the upper and lower sides. Accordingly, the efficiency of a discharge can be improved and the brightness of a display image can be increased.

In an embodiment, the black matrices 331 and 332 can have a structure in which they are separated from each other with a first region 350 of the traverse harrier rib interposed therebetween. Here, the first region 350 overlaps with a virtual line (indicated by a dotted line) extending from the second protrusion electrode 316. Accordingly, if simultaneous sintering for the electrodes and the matrices is performed as described above, the black matrices 331 and 332 and the second protrusion electrode 316 over the traverse barrier rib can be prevented from being short-circuited.

Figure 17:
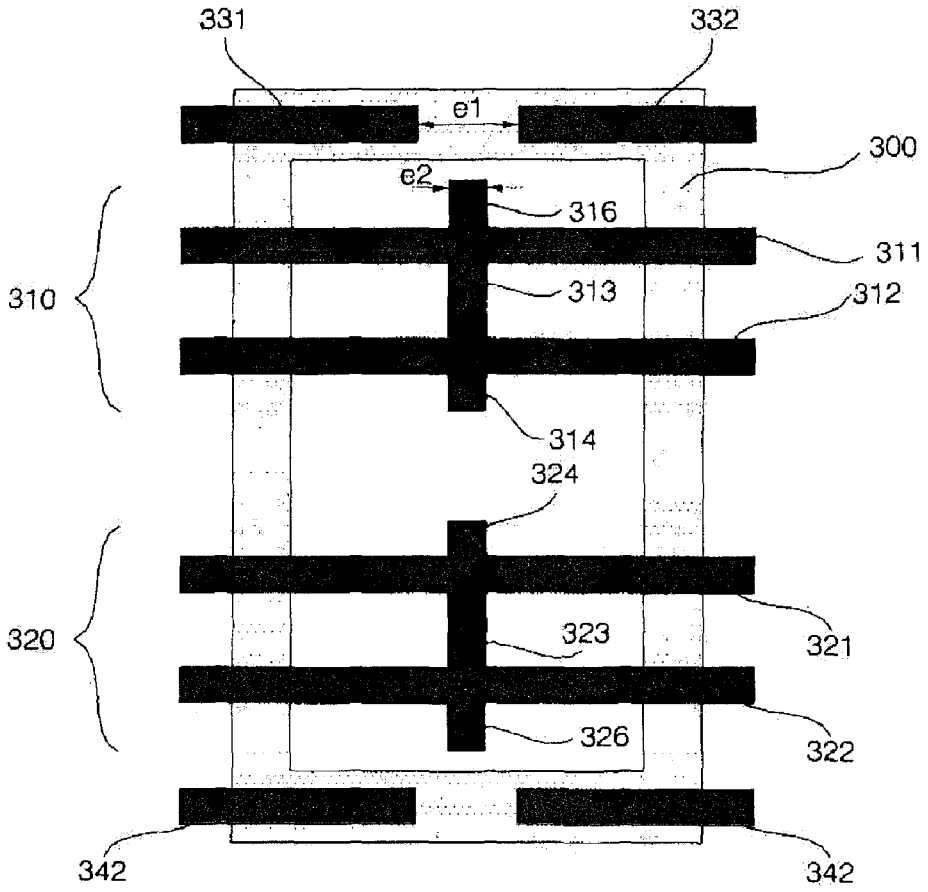

To effectively prevent the black matrices 331 and 332 and the second protrusion electrode 316 over the traverse barrier rib from being short-circuited when the simultaneous sintering process is performed, an interval 'e1' between the two black matrices 331 and 332 preferably is larger than a width 'e2' of the second protrusion electrode 316, as shown in FIG. 17.

In this case, if the interval 'e1' between the two black matrices 331 and 332 is increased, the contrast of a display image can be deteriorated. If the width 'e2' of the second protrusion electrode 316 is reduced, the efficiency of discharge diffusion can be decreased.

Accordingly, to improve the efficiency of discharge diffusion and the easy of forming the electrode pattern without greatly deteriorating the contrast of a display image, the interval 'e1' between the two black matrices 331 and 332 preferably is 1.4 to 2.1 times greater than the width 'e2' of the second protrusion electrode 316.

Figure 18:
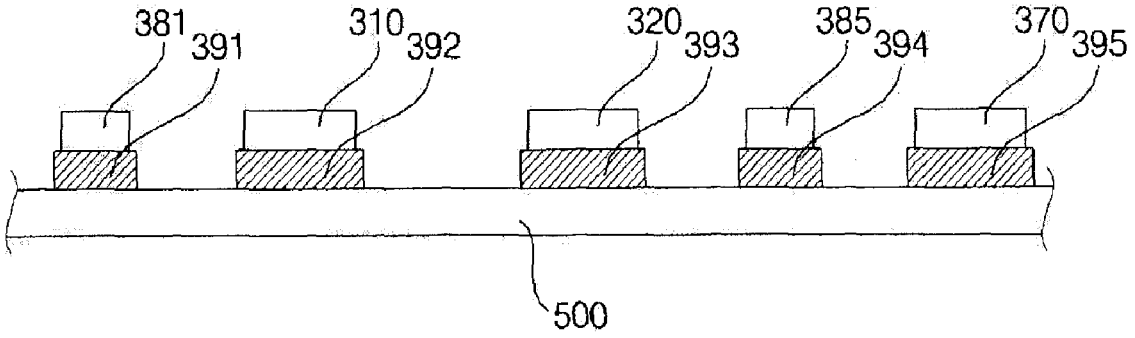
FIGS. 18 to 20 are cross-sectional views illustrating embodiments referring to the structure of electrodes formed on the upper substrate of the plasma display panel according to an embodiment of the present invention.
Figure 19:
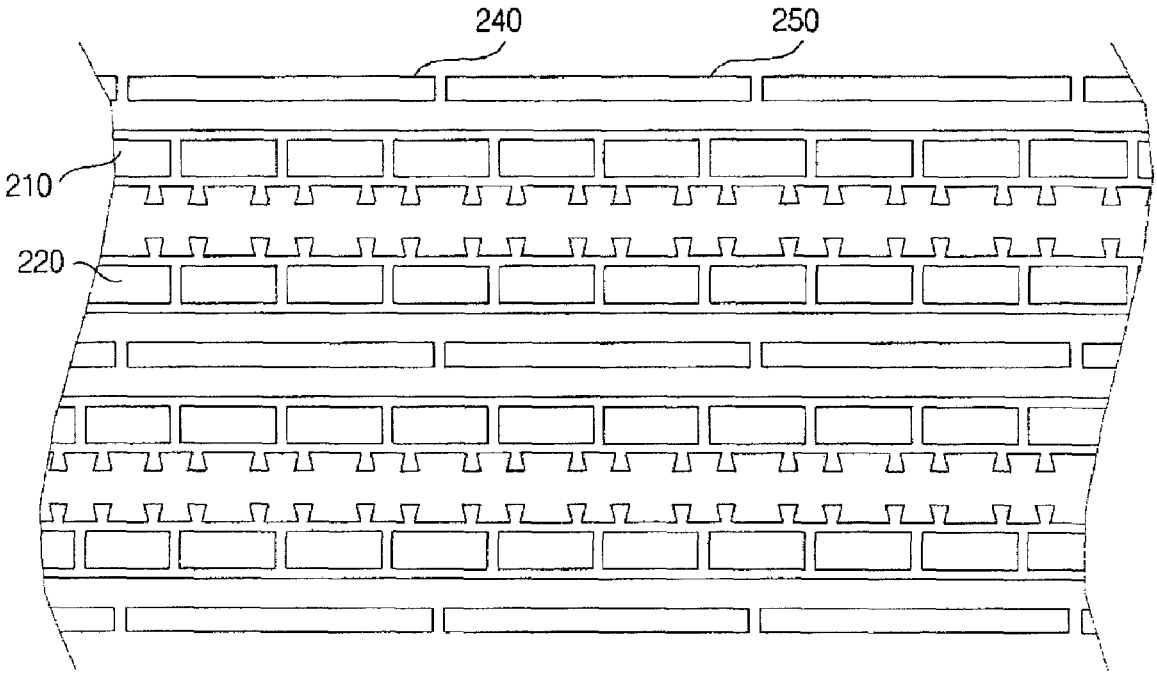
Figure 20:
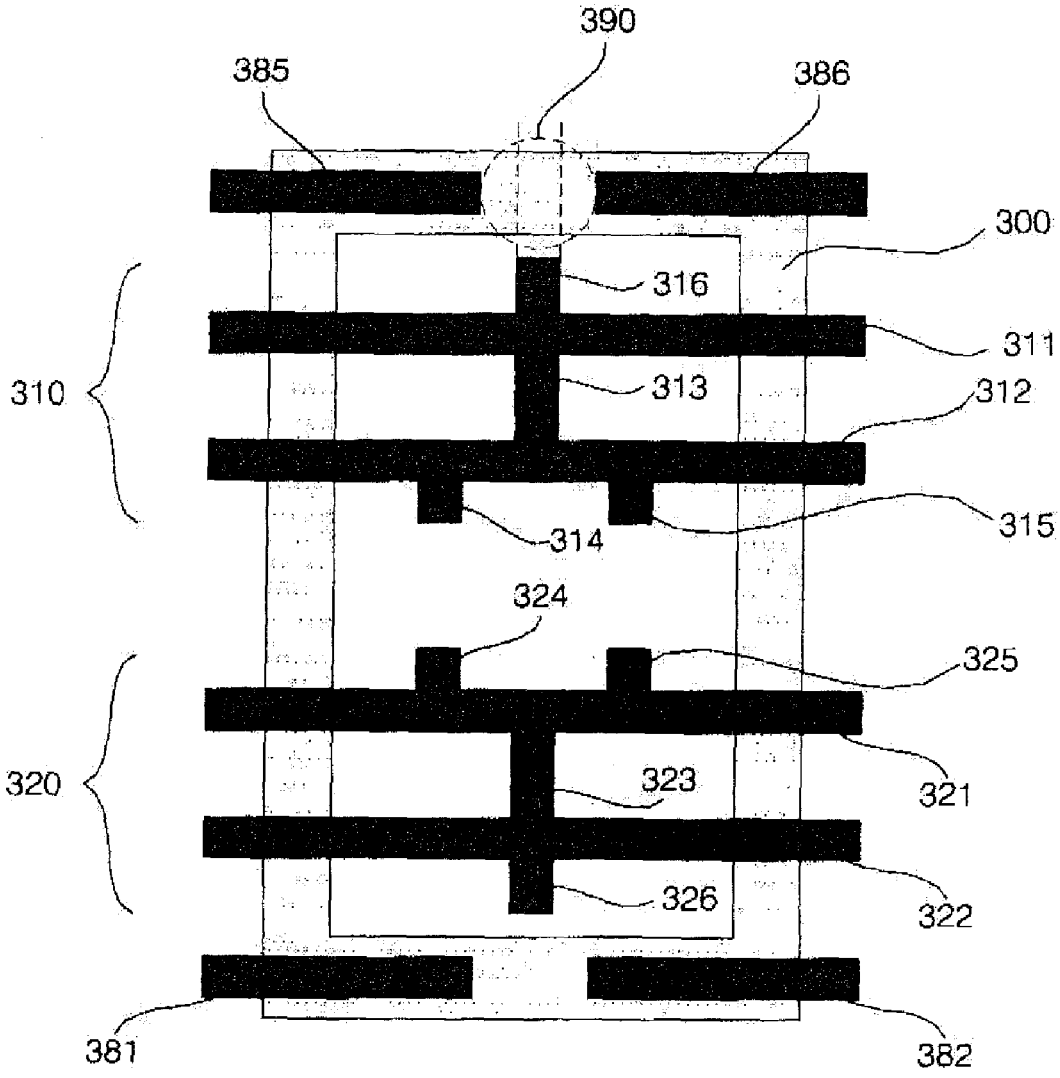

FIGS. 18 to 20 are cross-sectional views illustrating embodiments referring to the structure of electrodes formed on the upper substrate of the plasma display panel according to an embodiment of the present invention.

FIG. 18 is a cross-sectional view schematically showing an embodiment referring to the structure of an upper substrate of a plasma display panel according to the present invention. As shown in FIG. 18, black matrices 391 and 394 and black matrices 392, 393, and 395 are formed on an upper substrate 500.

Floating electrodes 381 and 385 are formed on the respective black matrices 391 and 394 configured to overlap with a traverse barrier rib (not shown), and scan electrodes or sustain electrodes constituting a single layer are formed on the black matrices 392, 393, and 395.

A width of each of the floating electrodes 381 and 385 preferably is larger than a width W of the traverse harrier rib (not shown) and is smaller than a width of each of the black matrices 391 and 394 configured to overlap with the traverse barrier rib (not shown). More preferably, a width of each of the floating electrodes 381 and 385 is 10 to 20 μm smaller than a width of each of the black matrices 391 and 394. If the width of each of the floating electrodes 381 and 385 and the width of each of the black matrices 391 and 394 has the above difference, reflectance can be reduced by absorbing external light, and a contrast of an image can be improved.

When a certain voltage or more is applied between the floating electrode 385 and the scan electrode (Y) 320, a discharge is generated between the two electrodes 320 and 385, and so electric charges are accumulated in the scan electrode (Y) 320. The accumulated electric charges cause to lower a discharge firing voltage between the scan electrode (Y) 320 and the sustain electrode (Z) 310.

An example in which a discharge is generated between the floating electrode 385 and the scan electrode (Y) 320 has been described above. In an embodiment, a discharge can be generated between the floating electrode 385 and a sustain electrode (Z) 370 by applying a certain voltage or more between the floating electrode 385 and the sustain electrode (Z) 370. Alternatively, the sequence of arrangement of the sustain electrodes and the scan electrodes can be changed.

An interval between the floating electrodes 381, 385 and the scan electrode 320 or the sustain electrodes (Z) 310, 370 preferably ranges from 40 to 60 μm. In this case, electric charges can be accumulated in the sustain electrodes 310, 370, and 320 because an initial discharge is stably generated between the floating electrodes 381 and 385 and the sustain electrodes 310, 370, and 320.

A method of forming the black matrices, the sustain electrodes (Z) 310 and 370, the scan electrode (Y) 320, and the floating electrodes 381 and 385 having a structure, such as that shown in FIG. 18, over an upper substrate 500 is described below. A black matrix layer is printed on the upper substrate 500, and a metal electrode layer, such as silver (Ag), is then printed. The black matrix layer and the metal electrode layer are adsorbed to the upper substrate 500 through exposure. The above method helps the number of exposure processes to be reduced from twice to one time.

Further, two or more floating electrodes can be formed on each of the black matrices 391 and 394, constituting a first group, over the upper substrate 500.

The floating electrodes are formed over the black matrix overlapping with the barrier rib, thereby generating a discharge between the floating electrodes and the sustain electrodes. In this case, although an initial discharge firing voltage of a sustain discharge between the sustain electrodes can be lowered, a short can occur between the floating electrodes and the sustain electrodes (i.e., first and electrodes), as in the black matrices.

The plasma display apparatus according to an embodiment of the present invention may include an upper substrate, a first electrode and a second electrode formed on the upper substrate, a lower substrate disposed to face the upper substrate, and a third electrode and a barrier rib formed in the lower substrate. Here, fourth and fifth electrodes are formed in the upper substrate and are separated from each other on the same straight line.

As shown in FIG. 19, floating electrodes respectively including fourth and fifth electrodes 240 and 250 are formed on the same straight line in a line pattern and are separated from each other. Accordingly, although each of the floating electrodes becomes electrically conductive due to an alien substance, etc., it does not have an influence on other floating electrodes.

Further, the first and second electrodes 210 and 220 may be bus electrodes. In other words, the first and second electrodes may be formed without ITO electrodes.

The first electrodes 210, the second electrodes 220, and the line patterns can be formed in parallel. In other words, the fourth and fifth electrodes 240 and 250 can be formed in a direction parallel to the first and second electrodes.

To reduce the time taken for the panel manufacturing process and more facilitate the manufacturing process, the exposure processes can be integrated, and the bus electrodes, the floating electrodes, and the black matrices can be exposed and sintered over the upper substrate of the panel at the same time. If, as described above, the electrodes and the black matrices are exposed and sintered at the same time, there may be a problem in that a short occurs between the bus electrodes and the black matrices and between the bus electrodes and the floating electrodes.

If such a short occurs, a streak of a bright belt corresponding to the traverse length of the entire active region is visible to the naked eye because the floating electrodes are interconnected in a straight line. It has a bad influence on the picture quality.

In accordance with the present invention, although a short occurs in one of the floating electrodes, only the corresponding floating electrode is influenced, but the remaining floating electrodes are not influenced because the fourth and fifth electrodes are separated from each other. Accordingly, a bright stripe belt does not occur. Further, since the width of the bus electrode and the black matrix needs not to be changed, there is an advantage in that the panel manufacturing process and the cost of production can be reduced through the integrated exposure process. Moreover, reflectance, a contrast ratio, and efficiency can be maintained to a high level of quality.

FIG. 20 is a cross-sectional view showing an embodiment referring to the structure of electrodes formed on the upper substrate of the plasma display apparatus according to an embodiment of the present invention.

In the plasma display apparatus according to an embodiment of the present invention, the barrier rib includes a traverse barrier rib formed in a direction to cross the third electrode. The first electrode includes first and second electrode lines formed in a direction to cross the third electrode, a first protrusion electrode configured to protrude from the first electrode line close to a center of a discharge cell, from among the first and second electrode lines, toward the center of the discharge cell, and a second protrusion electrode configured to protrude from the second electrode line toward the traverse barrier rib. The fourth and fifth electrodes are separated from each other with a first region of the traverse barrier rib interposed therebetween. Here, a virtual line extending from the second protrusion electrode overlaps with at least part of the first region.

Referring to FIG. 20, second protrusion electrodes 316 and 326 function to diffuse a discharge, generated between first protrusion electrodes 314, 315 and 324, 325, up to the outskirts of a discharge cell on the upper and lower sides, thereby being capable of improving the efficiency of a discharge and the brightness of a display image.

Further, fourth and fifth electrodes 385 and 386 can have a structure in which they are separated from each other with a first region 390 of a traverse barrier rib interposed therebetween. The first region overlaps with an extension line (indicated by a dotted line) of the second protrusion electrode 316. Accordingly, if simultaneous exposure is performed as described above, a short between the fourth and fifth electrodes 385, 386 and the second protrusion electrode 316 can be prevented.

FIGS. 21 to 26 are cross-sectional views illustrating embodiments referring to the structure of electrodes formed on the upper substrate of the plasma display panel according to an embodiment of the present invention.

Figure 21:
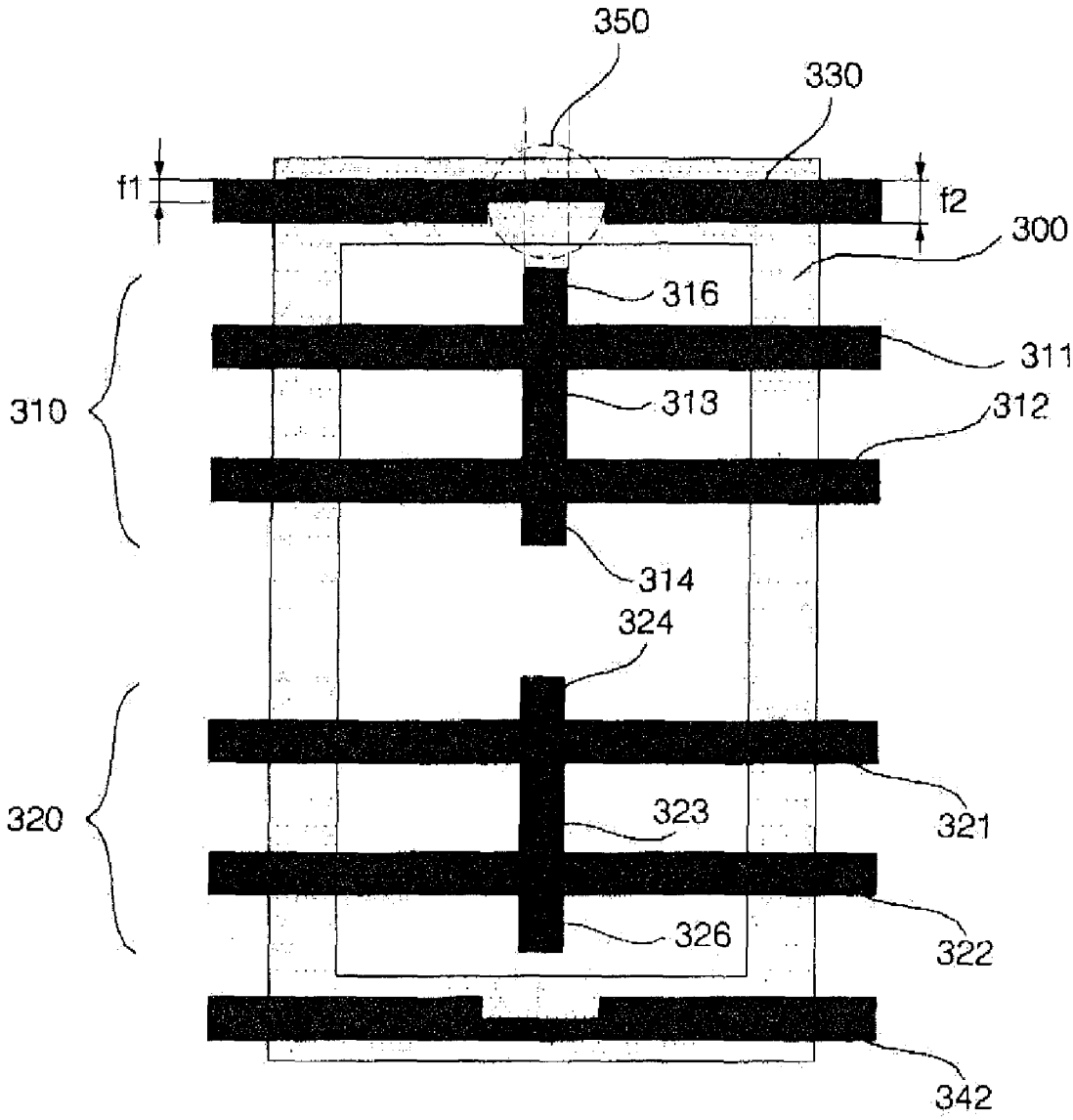
FIGS. 21 to 26 are cross-sectional views illustrating embodiments referring to the structure of electrodes formed on the upper substrate of the plasma display panel according to an embodiment of the present invention.

FIG. 21 is a cross-sectional view showing an embodiment referring to the structure of electrodes and black matrices formed over the upper substrate of the plasma display apparatus according to the present invention.

In an embodiment of the plasma display apparatus according to the present invention, a black matrix 330 formed on a traverse barrier rib can have a narrower width at the central portion of the traverse barrier rib than a width at the remaining portions of the traverse barrier rib. Accordingly, the pattern of the electrodes 310 and 320 of the upper substrate can be easily formed, and a short between the black matrix 330 and electrodes 310 and 320 of the upper substrate can be prevented.

Referring to FIG. 21, a concave groove can be formed in the black matrix 330 in the direction of the second protrusion electrode 316. In more detail, the groove of the black matrix 330 can be formed in a first region 350 in which the traverse barrier rib overlaps with a line (indicated by a dotted line) extending from the second protrusion electrode 316.

That is, a width 'f1' of the black matrix 330 in the first region 350 in which the traverse barrier rib overlaps with a virtual line (indicated by a dotted line) extending from the second protrusion electrode 316 can be smaller than a width 'f2' of the black matrix 330 in the remaining regions. Accordingly, if simultaneous exposure is performed as described above, a short between the second protrusion electrode 316 and the black matrix 330 over the traverse barrier rib can be prevented.

However, if the width 'f1' of the black matrix 330 in the first region 350 is decreased, the contrast of a display image can be deteriorated, and it may be difficult to form a pattern of the black matrix 330.

Figure 22:
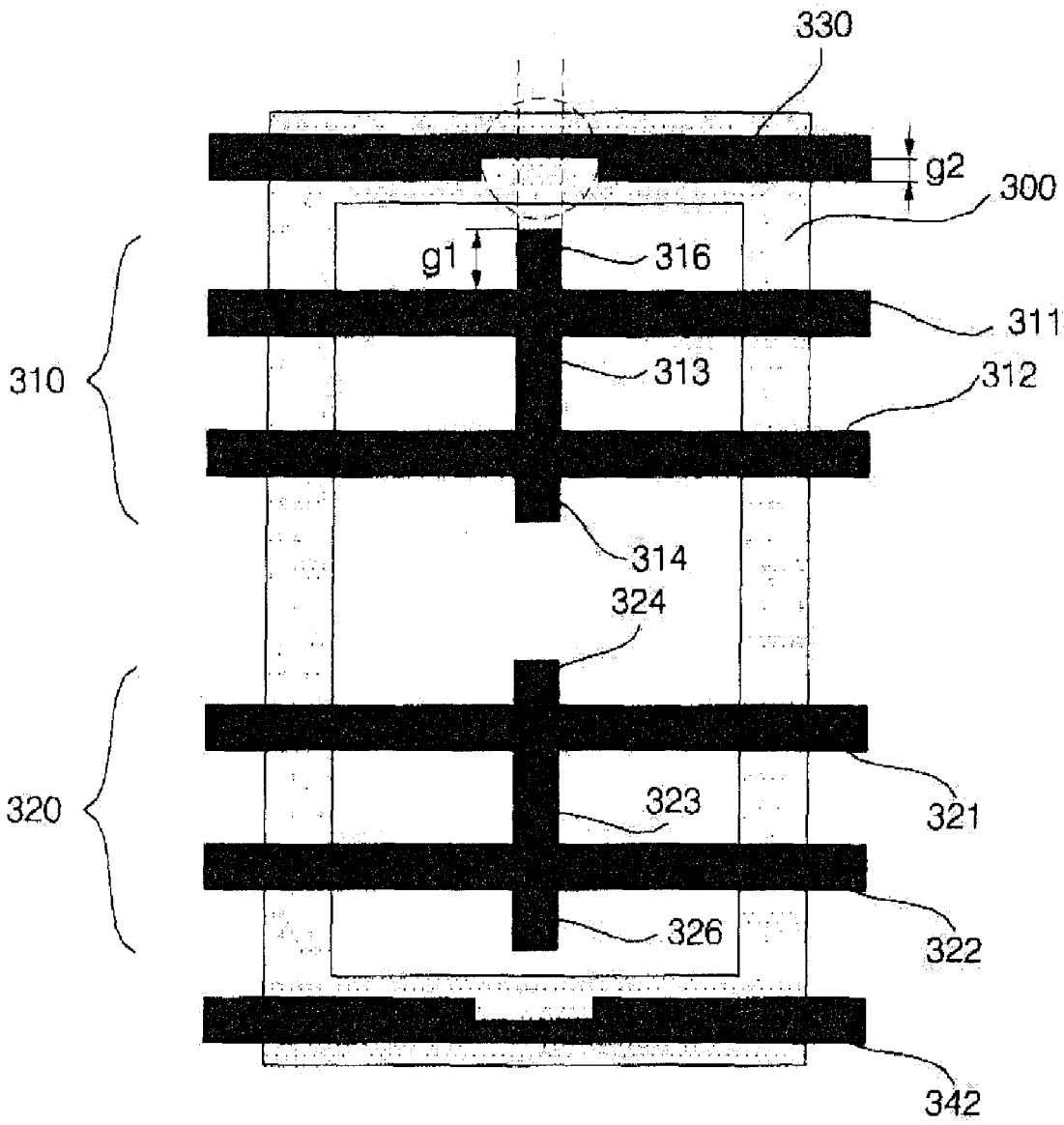

To easily form the pattern of the black matrix 330 and the electrodes 310 and 320 of the upper substrate and prevent a short between the black matrix 330 and the second protrusion electrode 316 without greatly deteriorating the contrast of a display image, a depth 'g2' of a groove 333 formed in the black matrix 330 preferably is 0.85 to 1.5 times greater than a length 'g1' of the second protrusion electrode 316, as shown in FIG. 22.

Figure 23:
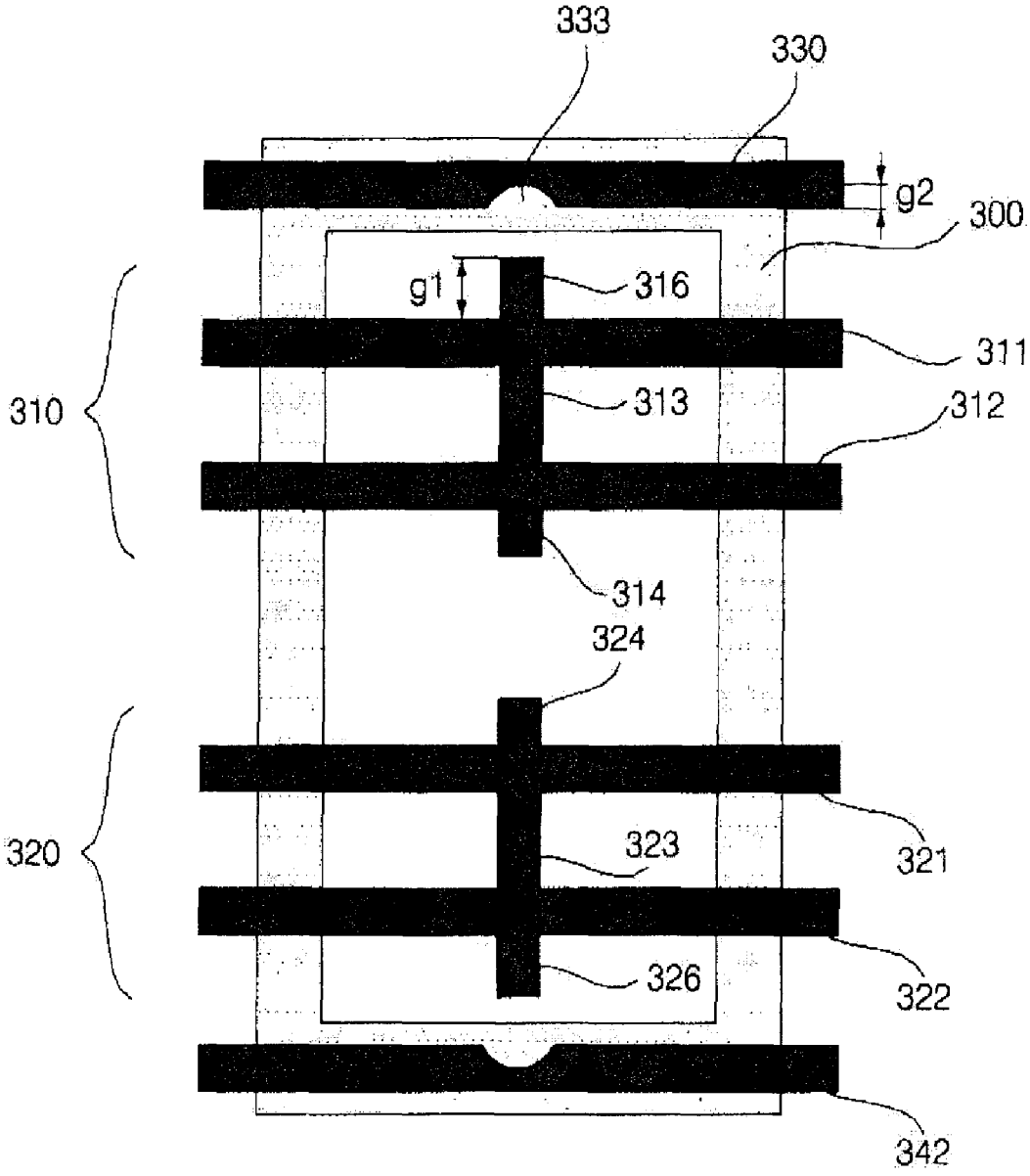

As shown in FIG. 23, the groove 333 formed in the black matrix 330 may have a round section different from the shape shown in FIG. 22.

Figure 24:
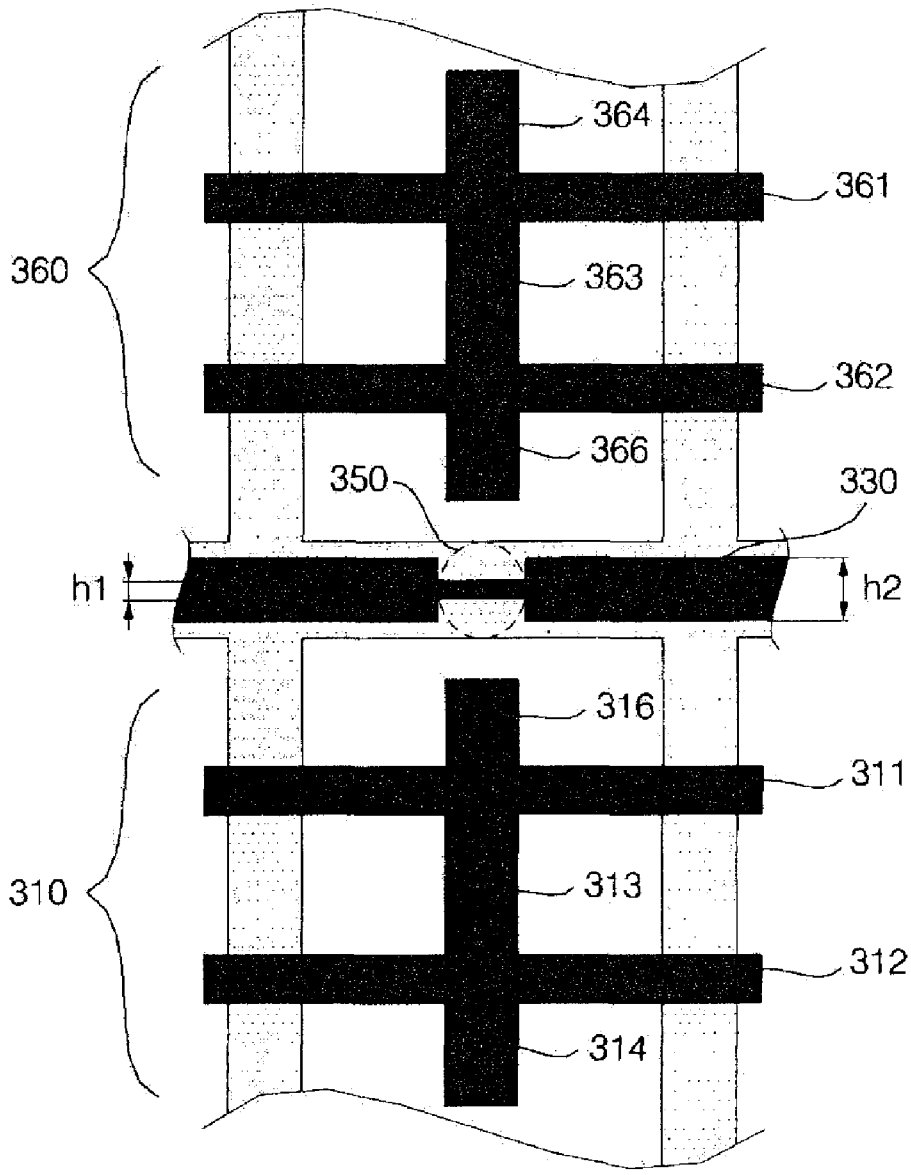

Further, to prevent a short between second protrusion electrodes 316 and 366 formed up and down in two neighboring discharge cells and the black matrix 330 formed on the traverse barrier rib when simultaneous exposure is performed, two or more grooves being concave up and down can be formed at a central portion 350 of the black matrix 330, as shown in FIG. 24.

Here, to easily form the pattern of the black matrix 330 and the electrodes 310 and 320 of the upper substrate and prevent a short between the black matrix 330 and the second protrusion electrodes 316 and 366 while not greatly deteriorating the contrast of a display image, a width 'h1' of the black matrix 330 in the central portion 350 preferably is 0.15 to 0.4 times greater than a width 'h2' of the central portion 350 in the remaining regions.

Figure 25:
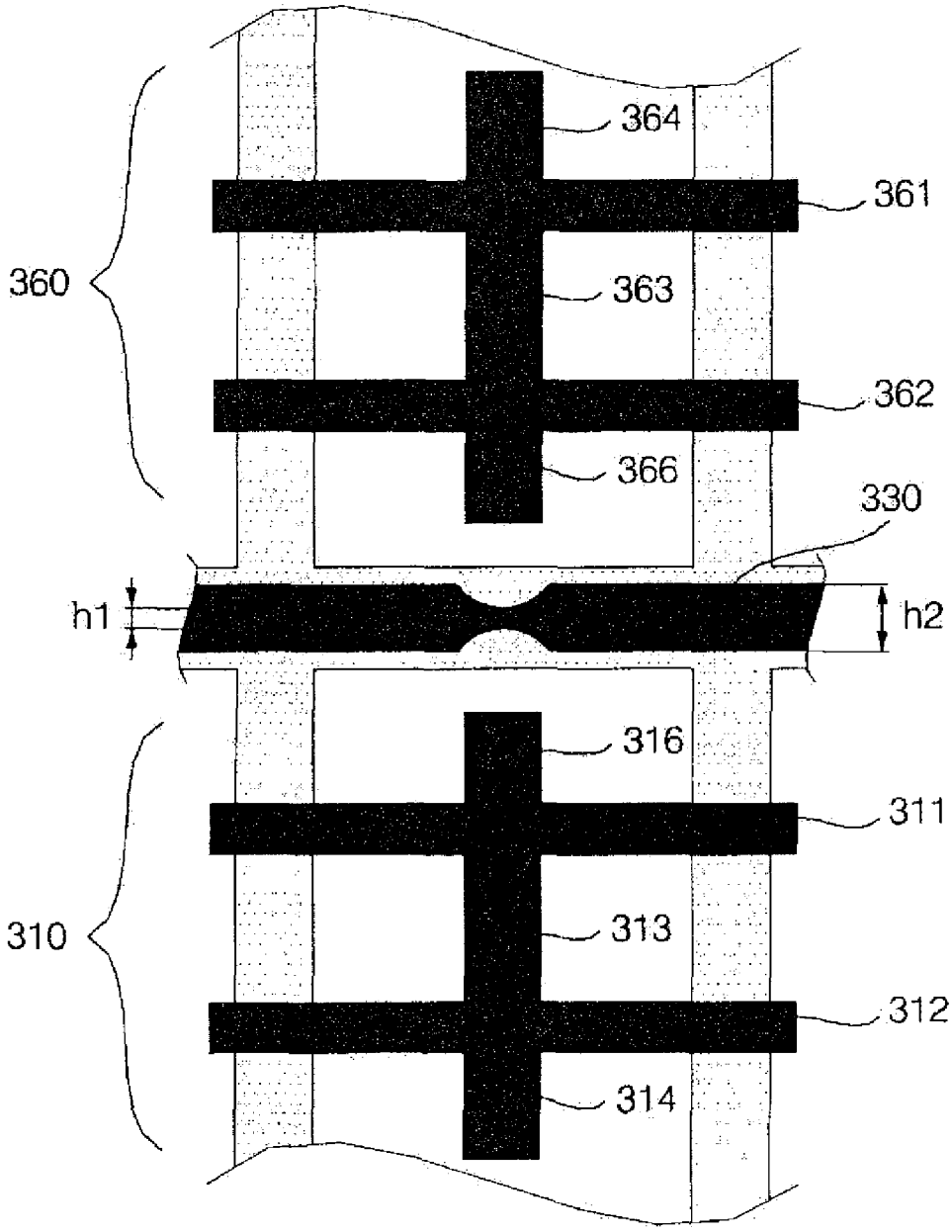

As shown in FIG. 25, the shape of the two or more grooves formed in the black matrix 330 may have various shapes different from that shown in FIG. 24.

Figure 26:
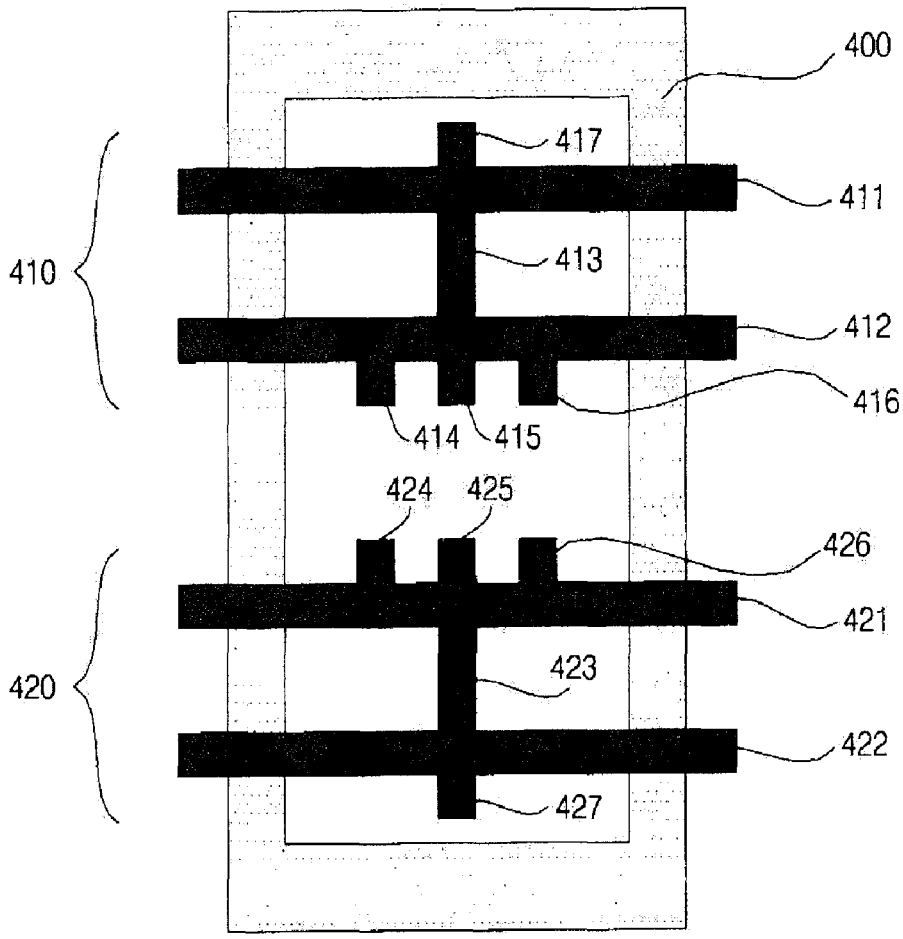

As shown in FIG. 26, the plasma display panel according to the present invention may further comprise protrusion electrodes 417 and 427 protruding from respective electrode lines 411 and 422 located at the outskirts of a discharge cell, from among electrode lines.

Further, the number of protrusion electrodes 414, 415, 416 and 424, 425, 426 protruding from respective electrode lines 412 and 421 close to the center of the discharge cell, from among the electrode lines, may be more than 6.

Although some preferred embodiments of the present invention have been described above, those having ordinary skill in the art will appreciate that the present invention may be modified in various forms without departing from the spirit and scope of the present invention defined in the appended claims. Accordingly, a possible change of the embodiments of the present invention may not deviate from the technology of the present invention.

The invention claimed is:

1. A plasma display apparatus, comprising:

an upper substrate;

a first electrode and a second electrode coupled to the upper substrate;

a lower substrate disposed to face the upper substrate; and a third electrode and a barrier rib coupled to the lower substrate, wherein first and second black matrices are coupled to the upper substrate and are separated from each other on substantially a same straight line, wherein the plasma display apparatus further comprises a traverse barrier rib to cross the third electrode, and wherein:

the first electrode includes a first electrode line and a second electrode line that cross the third electrode, a first protrusion electrode is to protrude from the first electrode line toward a center of a discharge cell, a second protrusion electrode is to protrude from the second electrode line toward the traverse barrier rib, a first region that includes the traverse barrier rib is interposed between the first and second black matrices, and a virtual line extending from the second protrusion electrode overlaps at least part of the first region.

2. The plasma display apparatus of claim 1, wherein a width of the first black matrix or the second black matrix is smaller than a width of the traverse barrier rib.

3. The plasma display apparatus of claim 1, wherein at least one of the first black matrix or the second black matrix overlaps the traverse barrier rib.

4. The plasma display apparatus of claim 1, wherein the first and second black matrices are formed substantially in parallel to the first electrode and the second electrode.

5. The plasma display apparatus of claim 1, wherein the first and second electrodes are or include bus electrodes.

6. The plasma display apparatus of claim 1, wherein the first and second black matrices have different lengths.

7. The plasma display apparatus of claim 1, wherein an interval between the first and second black matrices ranges from 30 um to 50 um.

8. The plasma display apparatus of claim 1, further comprising a third black matrix coupled to the upper substrate and which overlaps the traverse barrier rib.

9. The plasma display apparatus of claim 8, wherein the first and second electrodes are disposed in two discharge cells neighboring the traverse barrier rib, and wherein the first and second electrodes are symmetrical to the traverse barrier rib.

10. The plasma display apparatus of claim 1, wherein an interval between the first and second electrode lines is substantially 2.25 to 5.2 times greater than a width of the first electrode line.

11. The plasma display apparatus of claim 1, wherein an interval between the first and second black matrices is substantially 1.4 to 2.1 times greater than a width of the second protrusion electrode.

12. The plasma display apparatus of claim 1, wherein a width of the second electrode line is larger than a width of the first electrode line.

13. The plasma display apparatus of claim 12, wherein the width of the second electrode line is substantially 1.1 to 2 times greater than the width of the first electrode line.

14. A plasma display apparatus, comprising:

an upper substrate;

a first electrode and a second electrode coupled to the upper substrate;

a lower substrate disposed to face the upper substrate; and a third electrode and a barrier rib lower substrate, wherein fourth and fifth electrodes are coupled to the upper substrate and are separated from each other on substantially a same straight line, wherein:

the barrier rib comprises a traverse barrier rib to cross the third electrode, the first electrode comprises a first electrode line and a second electrode line to cross the third electrode, a first protrusion electrode is to protrude from the first electrode line toward a center of a discharge cell, a second protrusion electrode is to protrude from the second electrode line toward the traverse barrier rib, first region the traverse barrier rib is interposed between the fourth and fifth electrodes, and virtual lute extending from second protrusion electrode overlaps at least part of the first region.

15. The plasma display apparatus of claim 14, wherein the first and second electrodes are or comprise bus electrodes.

16. A plasma display apparatus, comprising:

an upper substrate;

a first electrode and a second electrode coupled to the upper substrate;

a lower substrate disposed to face the upper substrate; and a third electrode and a barrier rib coupled to the lower substrate, wherein the barrier rib comprises a traverse barrier rib to cross the third electrode, and wherein:

the first electrode comprises first and second electrode lines to cross the third electrode, a first protrusion electrode configured to protrude from the first electrode line toward a center of a discharge cell, a second protrusion electrode configured to protrude from the second electrode line toward the traverse barrier rib, and a width of a black matrix formed in a first region including the traverse barrier rib is narrower than a width of the black matrix formed in a region different from titan the first region, and wherein a virtual line extending from the second protrusion electrode overlaps with at least part of the first region.

17. The plasma display apparatus of claim 16, wherein:

the black matrix formed in the first region of the traverse barrier rib has a concave groove toward the second protrusion electrode, and a depth of the groove is substantially 0.85 to 1.5 times greater than a length of the second protrusion electrode.

18. The plasma display apparatus of claim 16, wherein the width of the black matrix formed in the first region of the traverse barrier rib is substantially 0.15 to 0.4 times greater than the width of the black matrix formed in the region different from the first region.

* * * * *